US010733971B2

(12) United States Patent
Hayashi et al.

(10) Patent No.: US 10,733,971 B2
(45) Date of Patent: Aug. 4, 2020

(54) SOUND PROCESSING DEVICE, SOUND PROCESSING METHOD, AND COMPUTER PROGRAM

(71) Applicant: Sony Corporation, Tokyo (JP)

(72) Inventors: Shigetoshi Hayashi, Kanagawa (JP); Kohei Asada, Kanagawa (JP); Tetsunori Itabashi, Kanagawa (JP); Kazuma Yoshii, Tokyo (JP); Mitsuhiro Suzuki, Tokyo (JP); Shinpei Tsuchiya, Kanagawa (JP); Yushi Yamabe, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 16/307,623

(22) PCT Filed: Apr. 18, 2017

(86) PCT No.: PCT/JP2017/015572

§ 371 (c)(1),
(2) Date: Dec. 6, 2018

(87) PCT Pub. No.: WO2017/217106

PCT Pub. Date: Dec. 21, 2007

(65) Prior Publication Data

US 2019/0266991 A1 Aug. 29, 2019

(30) Foreign Application Priority Data

Jun. 13, 2016 (JP) ..... 2016-117369

(51) Int. Cl.
*G10K 11/178* (2006.01)
*H04R 1/10* (2006.01)

(52) U.S. Cl.
CPC ..... *G10K 11/178* (2013.01); *G10K 11/17853* (2018.01); *G10K 11/17875* (2018.01);
(Continued)

(58) Field of Classification Search
CPC ..... G10K 11/178; G10K 11/17853; G10K 11/17885; G10K 11/17827;
(Continued)

(56) References Cited

U.S. PATENT DOCUMENTS 8,116,472 B2 * 2/2012 Mizuno ..... G10K 11/178 381/71.1
2010/0150367 A1 6/2010 Mizuno
(Continued)

FOREIGN PATENT DOCUMENTS

JP 2008-116782 A 5/2008
JP 2012-226366 A 11/2012
JP 2014-033303 A 2/2014

OTHER PUBLICATIONS

Extended European Search Report dated Jun. 26, 2019 in connection with European Application No. 17813012.6.
(Continued)

*Primary Examiner* — Paul Kim
*Assistant Examiner* — Ubachukwu A Odunukwe
(74) *Attorney, Agent, or Firm* — Wolf, Greenfield & Sacks, P.C.

(57) ABSTRACT

[Object] To provide a sound processing device capable of effectively reducing ambient noise at low cost.
[Solution] Provided is a sound processing device including: a first sound collector configured to collect a first noise signal from a noise source of noise leaking into a casing mounted to a user's ear; a first signal processing unit configured to form a first noise reduction signal used to reduce noise at a cancellation point on the basis of the first noise signal; a second signal processing unit configured to form a second noise reduction signal used to reduce noise at a cancellation point with respect to a first pseudo noise signal; an adder configured to add the first noise reduction signal and the second noise reduction signal; and a sound
(Continued)

emitter configured to emit an output of the adder into the casing as sound. The first pseudo noise signal is a signal obtained by subtracting an output of the adder applied with a simulation transfer characteristic from an output of the first sound collector, the simulation transfer characteristic being obtained by simulating a transfer characteristic from the sound emitter to the first sound collector.

11 Claims, 21 Drawing Sheets

(52) U.S. Cl.
CPC ..... *G10K 11/17885* (2018.01); *H04R 1/1083* (2013.01); *G10K 11/17827* (2018.01); *G10K 2210/1081* (2013.01); *G10K 2210/1082* (2013.01); *G10K 2210/1282* (2013.01); *G10K 2210/3028* (2013.01); *G10K 2210/3221* (2013.01)

(58) Field of Classification Search
CPC ..... G10K 11/17815; G10K 11/17817; G10K 2210/30232; G10K 2210/3028; H04R 1/1083; H04R 2420/05
USPC ..... 381/71.6, 71.1, 71.11
See application file for complete search history.

(56) References Cited

U.S. PATENT DOCUMENTS

2014/0037101 A1 2/2014 Murata et al.
2014/0363010 A1* 12/2014 Christopher ..... H04R 1/1083 381/71.6

OTHER PUBLICATIONS

International Written Opinion and English translation thereof dated Jun. 27, 2017 in connection with International Application No. PCT/JP2017/015572.
International Preliminary Report on Patentability and English translation thereof dated Dec. 27, 2018 in connection with International Application No. PCT/JP2017/015572.
International Search Report and English translation thereof dated Jun. 27, 2017 in connection with International Application No. PCT/JP2017/015572.

* cited by examiner

SOUND PROCESSING DEVICE, SOUND PROCESSING METHOD, AND COMPUTER PROGRAM

CROSS-REFERENCE TO RELATED APPLICATIONS

This application claims the benefit under 35 U.S.C. § 371 as a U.S. National Stage Entry of International Application No. PCT/JP2017/015572, filed in the Japanese Patent Office as a Receiving Office on Apr. 18, 2017, which claims priority to Japanese Patent Application Number JP2016-117369, filed in the Japanese Patent Office on Jun. 13, 2016, each of which is hereby incorporated by reference in its entirety.

TECHNICAL FIELD

The present disclosure relates to a sound processing device, a sound processing method, and a computer program.

BACKGROUND ART

A noise cancelling system that provides a satisfactory music playback environment for a listener (user) by reducing (cancelling) ambient noise (noise) in the external environment when the listener listens to music or the like through earphones, headphones, or the like is known. In one example, Patent Literature 1 discloses a twin-type ambient noise cancellation device in which a feedback-based noise cancelling technique using a microphone installed in the inside of a casing and a feedforward-based noise cancelling technique using a microphone installed on the outside of the casing are integrated.

CITATION LIST

Patent Literature

Patent Literature 1: JP 2008-116782A

DISCLOSURE OF INVENTION

Technical Problem

The twin-type ambient noise reduction device is capable of effectively reducing ambient noise. However, the twin-type ambient noise reduction device necessitates microphones installed on both the inside and the outside of the casing, which leads to an increase in cost and the size of device.

In view of this, the present disclosure proposes a novel and improved sound processing device, sound processing method, and computer program, capable of effectively reducing ambient noise at low cost.

Solution to Problem

According to the present disclosure, there is provided a sound processing device including: a first sound collector configured to collect a first noise signal from a noise source of noise leaking into a casing mounted to a user's ear; a first signal processing unit configured to form a first noise reduction signal used to reduce noise at a predetermined cancellation point on the basis of the first noise signal; a second signal processing unit configured to form a second noise reduction signal used to reduce noise at a predetermined cancellation point with respect to a first pseudo noise signal; an adder configured to add the first noise reduction signal and the second noise reduction signal; and a sound emitter configured to emit an output of the adder into the casing as sound. The first pseudo noise signal is a signal obtained by subtracting an output of the adder applied with a simulation transfer characteristic from an output of the first sound collector, the simulation transfer characteristic being obtained by simulating a transfer characteristic from the sound emitter to the first sound collector.

Further, according to the present disclosure, there is provided a sound processing method including: collecting, by a first sound collector, a first noise signal from a noise source of noise leaking into a casing mounted to a user's ear; forming a first noise reduction signal used to reduce noise at a predetermined cancellation point on the basis of the first noise signal; forming a second noise reduction signal used to reduce noise at a predetermined cancellation point with respect to a first pseudo noise signal; adding the first noise reduction signal and the second noise reduction signal; emitting, by a sound emitter, the added signal into the casing as sound; and applying a simulation transfer characteristic to the added signal, the simulation transfer characteristic being obtained by simulating a transfer characteristic from the sound emitter to the first sound collector. The first pseudo noise signal is a signal obtained by subtracting a signal applied with the simulation transfer characteristic from an output of the first sound collector.

Further, according to the present disclosure, there is provided a computer program causing a computer to execute: forming a first noise reduction signal used to reduce noise at a predetermined cancellation point on the basis of a first noise signal from a noise source of noise leaking into a casing mounted to a user's ear, the first noise signal being collected by a first sound collector; forming a second noise reduction signal used to reduce noise at a predetermined cancellation point with respect to a first pseudo noise signal; adding the first noise reduction signal and the second noise reduction signal; emitting, by a sound emitter, the added signal into the casing as sound; and applying a simulation transfer characteristic to the added signal, the simulation transfer characteristic being obtained by simulating a transfer characteristic from the sound emitter to the first sound collector. The first pseudo noise signal is a signal obtained by subtracting a signal applied with the simulation transfer characteristic from an output of the first sound collector.

Advantageous Effects of Invention

According to the present disclosure as described above, it is possible to provide a novel and improved sound processing device, sound processing method, and computer program, capable of effectively reducing ambient noise at low cost.

Note that the effects described above are not necessarily limitative. With or in the place of the above effects, there may be achieved any one of the effects described in this specification or other effects that may be grasped from this specification.

MODE(S) FOR CARRYING OUT THE INVENTION

Figure 1:
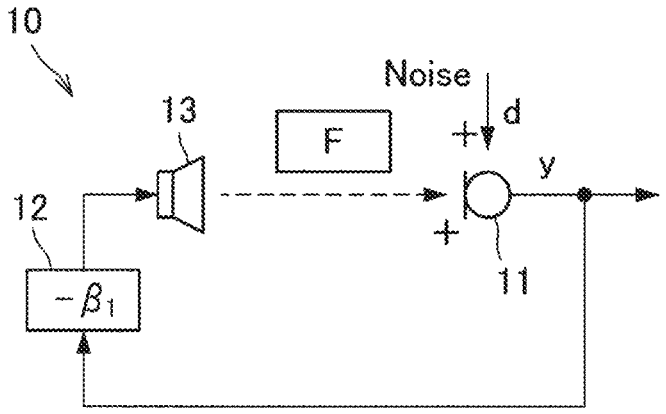
FIG. 1 is a diagram illustrated to describe an exemplary configuration of an ambient noise reduction device 10 that performs feedback-based noise cancellation processing using CCT method.

Hereinafter, (a) preferred embodiment(s) of the present disclosure will be described in detail with reference to the appended drawings. Note that, in this specification and the appended drawings, structural elements that have substantially the same function and structure are denoted with the same reference numerals, and repeated explanation of these structural elements is omitted.

Moreover, the description is given in the following order.

1. Embodiments of present disclosure
1.1. Overview
1.2. Exemplary configuration
1.3. Modification
2. Concluding remarks

1. EMBODIMENTS OF PRESENT DISCLOSURE

[1.1. Overview]

An overview of an embodiment of the present disclosure is described and then embodiments of the present disclosure are described in detail.

A noise cancelling system that provides a satisfactory music playback environment for a listener (user) by reducing (cancelling) ambient noise (noise) in the external environment when the listener listens to music or the like through earphones, headphones, or the like is known. Portable music players are especially widely used nowadays, and many users listen to music using headphones in music trial listening environments in the outside of the home in many cases. Thus, there is a growing demand for a noise cancellation function capable of listening to music in a condition similar to a quiet environment by reducing surrounding ambient noise even under noisy conditions.

The noise cancellation processing is typically known to use a feedback system and a feedforward system. In addition, a technique for performing twin-type noise cancellation processing using a combination of feedback system and feedforward system is also proposed, as described above. An overview of feedback-based noise cancellation processing is now described.

An ambient noise reduction device that performs the feedback-based noise cancellation processing is often designed on the basis of classical control theory. In the following description, a feedback-based noise cancellation method based on classical control theory is referred to as CCT method, taking the acronym for Classical Control Theory.

FIG. 1 is a diagram illustrated to describe an exemplary configuration of an ambient noise reduction device 10 that performs the feedback-based noise cancellation processing using CCT method. As illustrated in FIG. 1, the ambient noise reduction device 10 includes a microphone 11, a filter circuit 12, and a speaker 13.

The microphone 11 is provided at a position considered to be close to the user's ear, and collects sound at a position close to the user's ear. The microphone 11 thus collects external ambient noise reaching the ear. The microphone 11 sets the collected sound as a noise signal d and outputs it to the filter circuit 12. The sound collected by the microphone 11 is collected again by the microphone 11 via the filter circuit 12 and a transfer function F between the speaker 13 and the microphone 11. Thus, the microphone 11, the filter circuit 12, and the speaker 13 form what is called a closed loop.

The filter circuit 12 performs predetermined filtering processing on the noise signal that is output from the microphone 11 to generate a noise cancellation signal used to cancel external ambient noise reaching the user's ear. The filter circuit 12 performs the operation of gain, phase, and amplitude characteristics using a parameter $\beta_1$ for the noise signal output from the microphone 11. The filter circuit 12 can be implemented as, in one example, a finite impulse response (FIR) filter or an infinite impulse response (IIR) filter.

The speaker 13 outputs sound by vibrating a diaphragm (not shown) on the basis of the noise cancellation signal output from the filter circuit 12. The sound output from the speaker 13 is collected by the microphone 11 together with external ambient noise. Thus, the microphone 11 outputs a residual signal y corresponding to the noise that fails to be cancelled from the sound that is output on the basis of the noise cancellation signal. Moreover, the microphone 11 and the speaker 13 are provided inside a housing (or casing), which is not shown.

The residual signal y at the position of the microphone 11 in the feedback-based noise cancellation processing using CCT method is calculated in relation with the noise signal d, as expressed in Formula 1 below.

[Math. 1]

$$y = -y\beta_1 F + d \qquad \text{(Formula 1)}$$
$$(1+\beta_1 F)y = d$$
$$y = \frac{1}{1+\beta_1 F}d$$

Here, in Formula 1, $1/(1+\beta_1)$ is called a sensitivity function. It can be said that as the sensitivity function approaches zero, the noise signal d at the position of the microphone 11 decreases and the residual signal y approaches zero. In other words, it can be said that the feedback-based noise cancellation processing using CCT method can consequently reduce the noise signal d at the position of the microphone 11 by making the gain of $\beta_1$ of the filter circuit 12 large to increase the denominator of the sensitivity function.

The technique relating to the twin-type ambient noise reduction device that further reduces noise by combining the feedback-based noise cancellation processing with feedforward-based noise cancellation processing is disclosed, as described above. However, the twin-type ambient noise reduction device necessitates microphones installed on both the inside and the outside of the housing, which leads to an increase in cost and the size of device.

In view of the above-mentioned points, those who conceived the present disclosure have conducted intensive studies on the technology capable of improving the quality of noise reduction without increasing the cost or the size of device. As a result, those who conceived the present disclosure have devised the technology capable of improving the quality of noise reduction without increasing cost or the size of device, as described below.

The overview of the embodiment of the present disclosure is described above. Then, the embodiment of the present disclosure is now described in detail.

[1.2. Exemplary Configuration]

(Internal Model Control System)

An exemplary configuration of an ambient noise reduction device that performs feedback-based noise cancellation processing using an internal model control method is now described. In the following description, the internal model control method is also referred to as IMC method, taking the acronym for Internal Model Control.

Figure 2:
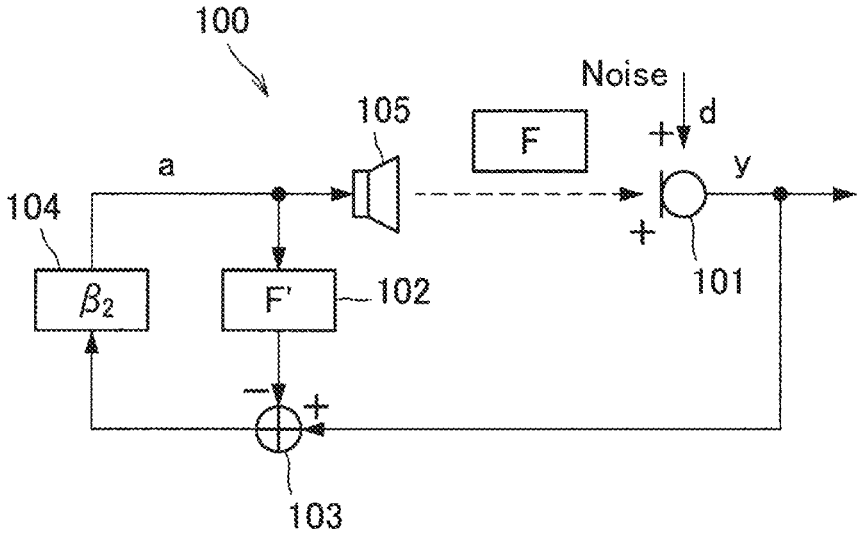
FIG. 2 is a diagram illustrated to describe an exemplary configuration of an ambient noise reduction device 100 that performs feedback-based noise cancellation processing using IMC method.

FIG. 2 is a diagram illustrated to describe an exemplary configuration of an ambient noise reduction device 100 that performs the feedback-based noise cancellation processing using IMC method. As illustrated in FIG. 2, the ambient noise reduction device 100 includes a microphone 101, a characteristic applying unit 102, a subtractor 103, a filter circuit 104, and a speaker 105. In the ambient noise reduction device 100 illustrated in FIG. 2, the characteristic applying unit 102 and the subtractor 103 are further included, as compared to the ambient noise reduction device 10 that performs the feedback-based noise cancellation processing using CCT method illustrated in FIG. 1.

The microphone 101 is provided at a position considered to be close to the user's ear, and collects sound at a position close to the user's ears. Thus, the microphone 101 collects external ambient noise reaching the ear. The microphone 101 sets the collected sound as a noise signal d and outputs it to the subtractor 103. The sound collected by the microphone 101 is collected again by the microphone 101 via the subtractor 103, the filter circuit 104, and a transfer function F between the speaker 105 and the microphone 101. Thus, the microphone 101, the subtractor 103, the filter circuit 104, and the speaker 105 form what is called a closed loop.

The characteristic applying unit 102 is a circuit that applies a predetermined characteristic F' to the output of the filter circuit 104 and outputs it. This characteristic F' is a characteristic obtained by simulating the transfer function F between the speaker 105 and the microphone 101, and is designed as plant simulation characteristics of the transfer function F. The characteristic applying unit 102 outputs a result obtained by applying the predetermined characteristic F' to the output of the filter circuit 104 to the subtractor 103.

The subtractor 103 subtracts the output of the characteristic applying unit 102 from the noise signal that is output from the microphone 101. The subtractor 103 outputs the signal obtained by subtraction to the filter circuit 104.

The filter circuit 104 performs predetermined filtering processing on the signal that is output from the subtractor 103 to generate a noise cancellation signal used to cancel the external ambient noise reaching the user's ear. The filter circuit 104 performs the operation of gain, phase, and amplitude characteristics using a parameter $\beta_2$ for the signal that is output from the subtractor 103. The filter circuit 104 can be implemented as, in one example, an FIR filter or an IIR filter.

The speaker 105 outputs sound by vibrating a diaphragm (not shown) on the basis of the noise cancellation signal that is output from the filter circuit 104. The sound that is output from the speaker 105 is collected by the microphone 101 together with external ambient noise. Thus, the microphone 101 outputs a residual signal y corresponding to the noise that fails to be cancelled from the sound that is output on the basis of the noise cancellation signal. Moreover, the microphone 101 and the speaker 105 are provided inside a housing (or casing), which is not shown.

The IMC method is a control method mainly used to control a system including dead time. As illustrated in FIG. 2, the IMC method has a feature that the internal model is included in a loop. In other words, the characteristic applying unit 102 that applies the characteristic F' corresponds to the internal model.

Similarly to CCT method, the residual signal y at the position of the microphone 101 in the feedback-based noise cancellation processing using IMC method is calculated in relation with the noise signal d, as expressed in Formula 2 below.

[Math. 2]

$$y = \frac{(1+\beta_2 F')}{1+\beta_2(F'-F)}d \quad \text{(Formula 2)}$$

Here, in Formula 2, the transfer function between d and y is called a sensitivity function. In the IMC method, the internal model F' is designed to approximate the plant F. Thus, if F'=F is approximately established, it can be said that the IMC method preferably design a filter used to minimize "$(1+\beta_2 F')$" that is a term of the numerator in the sensitivity function.

To summarize the CCT method and the IMC method, the CCT method can also be a method of making the denominator of the sensitivity function larger to reduce ambient noise by division. In addition, the IMC method can also be a method of reducing ambient noise by subtracting the numerator of the sensitivity function.

It can be said that the IMC method can be similar to the feedforward system. The reasons are as follows.

Figure 3:
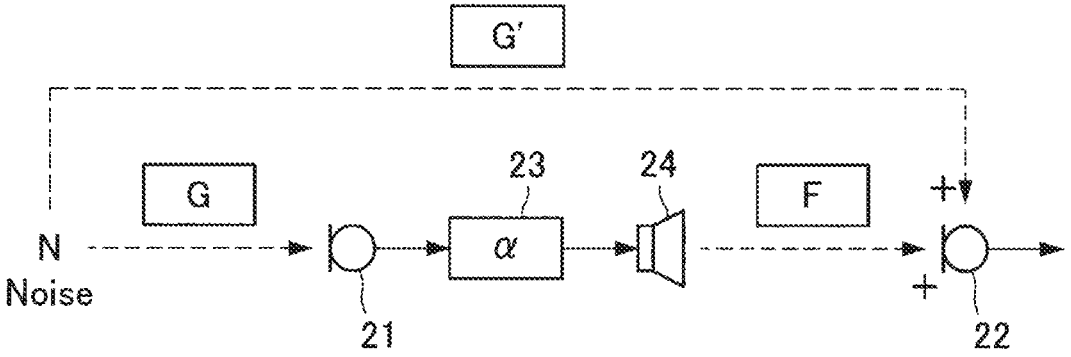
FIG. 3 is a diagram illustrated to describe blocks for signal processing in feedforward-based noise cancellation processing.

FIG. 3 is a diagram illustrated to describe blocks for signal processing in the feedforward-based noise cancellation processing.

In the feedforward system, a characteristic G is assumed to represent the transfer function from a noise source N to a reference microphone 21, and a characteristic G' is assumed to represent the transfer function from the noise source N to an error microphone 22. In addition, the transfer function between the speaker 24 and the error microphone 22 is set to F. In addition, in the feedforward system, the gain of an ambient noise reduction filter circuit 23 is set to $\alpha$.

The gain $\alpha$ of the ambient noise reduction filter circuit 23 for minimizing the residual signal at the position of the error microphone 22 in the feedforward system can be expressed as Formula 3 below.

[Math. 3]

$$NG' + NG\alpha F = 0 \quad \text{(Formula 3)}$$
$$\alpha = -\frac{G'}{GF}$$

On the other hand, in the feedback-based noise cancellation processing using IMC method illustrated in FIG. 2, if the internal model F' coincides with the transfer function F between the speaker 105 and the microphone 101, i.e., F'=F is established, the gain $\beta_2$ of the filter circuit 104 that minimizes the residual signal at the position of the microphone 101 can be expressed as Formula 4 below.

[Math. 4]

$$NG + NG\beta_2 F = 0 \quad \text{(Formula 4)}$$
$$\beta_2 = -\frac{G}{GF} = -\frac{1}{F}$$

When comparing Formula 3 with Formula 4, the feedback-based noise cancellation processing using IMC method can be expressed to be equivalent to the feedforward-based noise cancellation processing in the case where it is considered that the reference microphone is the same as the error microphone. In other words, the feedback-based noise cancellation processing using IMC method achieves the effect equivalent to that of the feedforward-based noise cancellation processing.

(Combination of CCT Method and IMC Method)

If the feedback-based noise cancellation processing using IMC method can achieve the effect equivalent to that of the feedforward-based noise cancellation processing, the combination of the feedback-based noise cancellation processing using CCT method with feedback-based noise cancellation processing using IMC method should make it possible to achieve the effect equivalent to that of the above-described twin-type noise cancellation processing with only one microphone.

Figure 4:
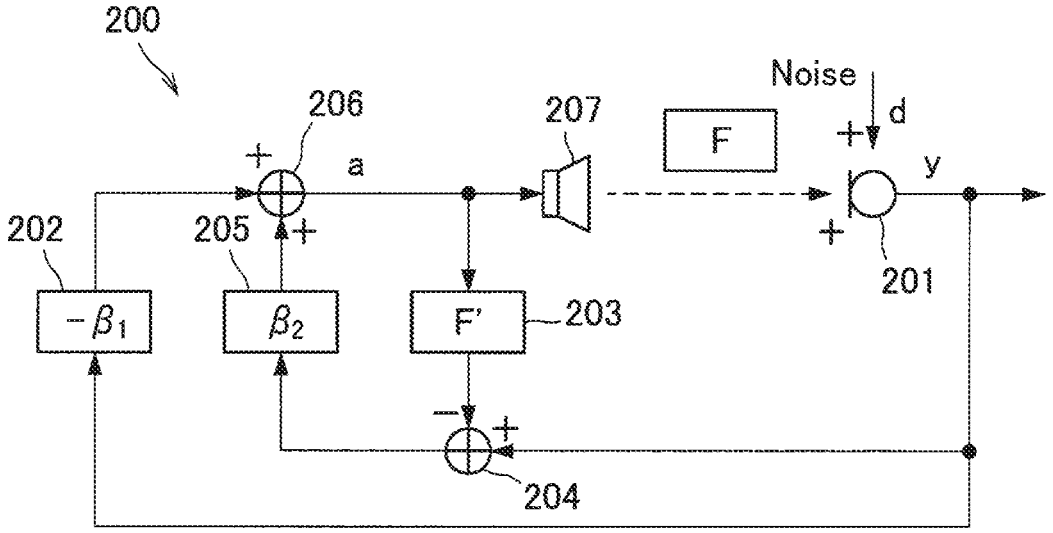
FIG. 4 is a diagram illustrated to describe an exemplary configuration of an ambient noise reduction device 200 that performs feedback-based noise cancellation processing using a combination of CCT method and IMC method.

FIG. 4 is a diagram illustrated to describe an exemplary configuration of an ambient noise reduction device 200 that performs the feedback-based noise cancellation processing using a combination of the CCT method and the IMC method according to the embodiment of the present disclosure. The feedback-based noise cancellation processing using the combination of the CCT method and the IMC method is also called a double feedback-based noise cancellation processing.

As illustrated in FIG. 4, the ambient noise reduction device 200 includes a microphone 201, filter circuits 202 and 205, a characteristic applying unit 203, a subtractor 204, an adder 206, and a speaker 207.

The microphone 201 is provided at a position considered to be close to the user's ear and collects sound at a position close to the user's ears. Thus, the microphone 201 collects external ambient noise reaching the ear. The microphone 201 sets the collected sound as a noise signal d and outputs it to the subtractor 204.

The filter circuit 202 performs predetermined filtering processing on the signal that is output from the microphone 201 to generate a noise cancellation signal used to cancel external ambient noise reaching the user's ear. The filter circuit 202 performs the operation of gain, phase, and amplitude characteristics using a parameter $\beta_1$ for the signal that is output from the microphone 201. The filter circuit 202 can be implemented as, in one example, an FIR filter or an IIR filter.

The filter circuit 205 performs predetermined filtering processing on the signal that is output from the subtractor 204 to generate a noise cancellation signal used to cancel external ambient noise reaching the user's ear. The filter circuit 205 performs the operation of gain, phase, and amplitude characteristics using parameter $\beta_2$ for the signal output from the subtractor 204. The filter circuit 205 can be implemented as, in one example, an FIR filter or an IIR filter.

The characteristic applying unit 203 is a circuit that applies a predetermined characteristic F' to the output of the adder 206 and outputs it. This characteristic F' is a characteristic obtained by simulating the transfer function F between the speaker 207 and the microphone 201, and is designed as a plant simulation characteristic of the transfer function F. The characteristic applying unit 203 outputs a value, which is obtained by applying a predetermined characteristic F' to the output of the adder 206, to the subtractor 204.

The subtractor 204 subtracts the output of the characteristic applying unit 203 from the noise signal that is output from the microphone 201. The subtractor 204 outputs the signal obtained by subtraction to the filter circuit 205.

The adder 206 adds the noise cancellation signal generated by the filter circuit 202 and the noise cancellation signal generated by the filter circuit 205. The adder 206 outputs the noise cancellation signal obtained by addition to the speaker 207.

The speaker 207 outputs sound by vibrating a diaphragm (not shown) on the basis of the noise cancellation signal that is output from the adder 206. The sound that is output from the speaker 207 is collected by the microphone 201 together with external ambient noise. Thus, the microphone 201 outputs a residual signal y corresponding to the noise that fails to be cancelled from the sound that is output on the basis of the noise cancellation signal. Moreover, the microphone 201 and the speaker 207 are provided inside a housing (casing), which is not shown.

The sensitivity function between the noise signal d and the residual signal y in the ambient noise reduction device 200 is calculated as expressed in Formula 5 below.

[Math. 5]

$$y = \frac{(1+\beta_2 F')}{1+\beta_2(F'-F)+\beta_1 F} d \quad \text{(Formula 5)}$$

Considering the sensitivity function in Formula 5, in the double feedback system, as the gain of the filter circuit 202 using CCT method increases and the gain of the filter circuit 205 using IMC method approaches the inverse characteristic of F', the ambient noise is reduced and the residual signal y approaches zero. In other words, the double feedback system can be a system intended to reduce the ambient noise from both terms of denominator and numerator in the sensitivity function in Formula 5.

The feedback-based noise cancellation processing using IMC method can obtain the effect equivalent to that of the feedforward-based noise cancellation processing. Thus, the ambient noise reduction device 200 illustrated in FIG. 4 uses the combination of the feedback-based noise cancellation processing using CCT method and the feedback-based noise cancellation processing using IMC method, thereby achieving the effect equivalent to that of the above-described twin-type noise cancellation processing. In addition, the ambient noise reduction device 200 illustrated in FIG. 4 can achieve the effect equivalent to that of the above-described twin-type noise cancellation processing with only one microphone 201.

(Combination of Feedforward System and IMC Method)

The feedback-based noise cancellation processing using IMC method can be combined with the feedback-based noise cancellation processing using CCT method, but it also can be combined with the feedforward-based noise cancellation processing.

Figure 5:
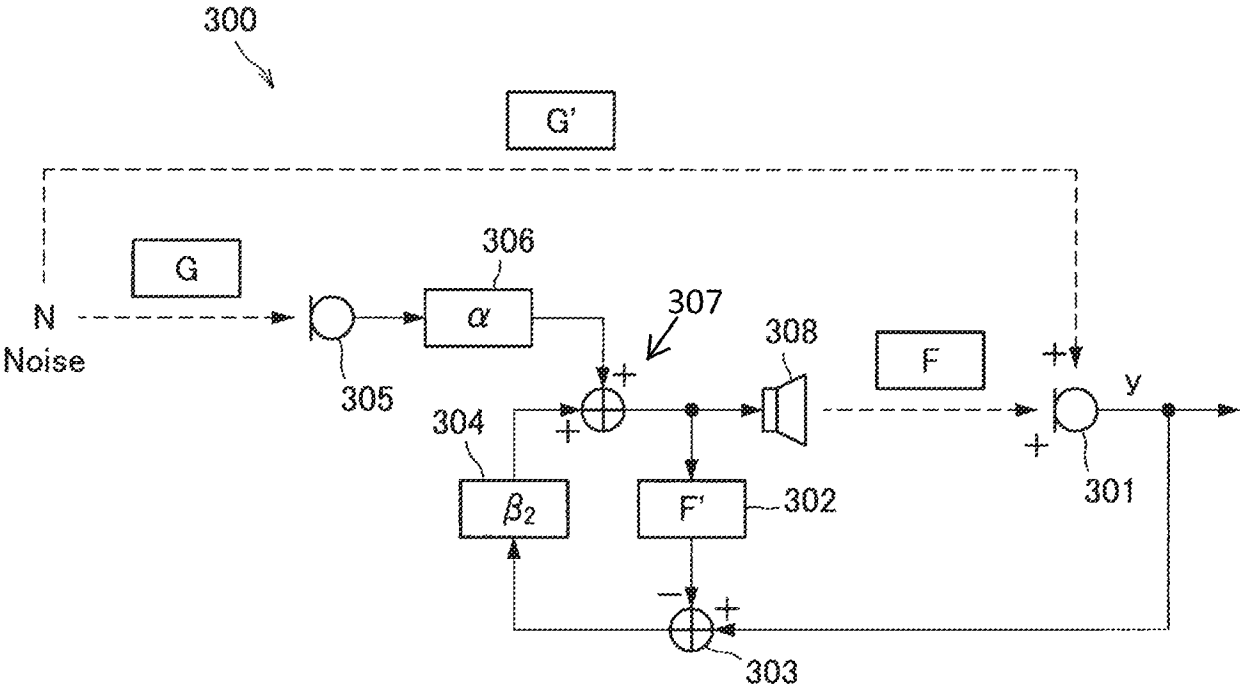
FIG. 5 is a diagram illustrated to describe an exemplary configuration of an ambient noise reduction device 300 using a combination of the feedback-based noise cancellation processing using IMC method and the feedforward-based noise cancellation processing.

FIG. 5 is a diagram illustrated to describe an exemplary configuration of an ambient noise reduction device 300 that employs the combination of the feedback-based noise cancellation processing using IMC method and the feedforward-based noise cancellation processing according to the embodiment of the present disclosure.

As illustrated in FIG. 5, the ambient noise reduction device 300 includes microphones 301 and 305, filter circuits 304 and 306, a characteristic applying unit 302, a subtractor 303, an adder 307, and a speaker 308. In FIG. 5, the transfer function from a noise source N to the microphone 305 is defined as G, and the transfer function from the noise source N to the microphone 301 is defined as G'. In other words, the noise signal d in the drawings referred to in the above description can be regarded as d=NG'.

The microphone 301, the characteristic applying unit 302, the subtractor 303, and the filter circuit 304 are equivalent to those of the ambient noise reduction device 100 that performs the feedback-based noise cancellation processing using IMC method illustrated in FIG. 2.

The microphone 305 and the filter circuit 306 are intended to perform the feedforward-based noise cancellation processing. The ambient noise coming from the noise source N is collected by the microphone 305 and is output to the filter circuit 306 as a noise signal. The filter circuit 306 performs the feedforward-based noise cancellation processing on the basis of the noise signal and outputs the noise cancellation signal to the adder 307. The adder 307 adds the noise cancellation signals that are output from the filter circuits 304 and 306 and outputs the resultant value to the speaker 308. Moreover, the microphone 301 and the speaker 308 are provided inside a housing (casing) that is not shown, and the microphone 305 is provided outside the housing (casing).

The ambient noise reduction device 300 illustrated in FIG. 5 combines the feedback-based noise cancellation processing using IMC method and the feedforward-based noise cancellation processing, thereby achieving more advantageous noise reduction effect as compared to the case where each is used individually.

(Combination of Feedforward System and Double Feedback System)

The combination of the feedforward-based noise cancellation processing and the double feedback-based noise cancellation processing makes it possible to achieve more advantageous noise reduction effect.

Figure 6:
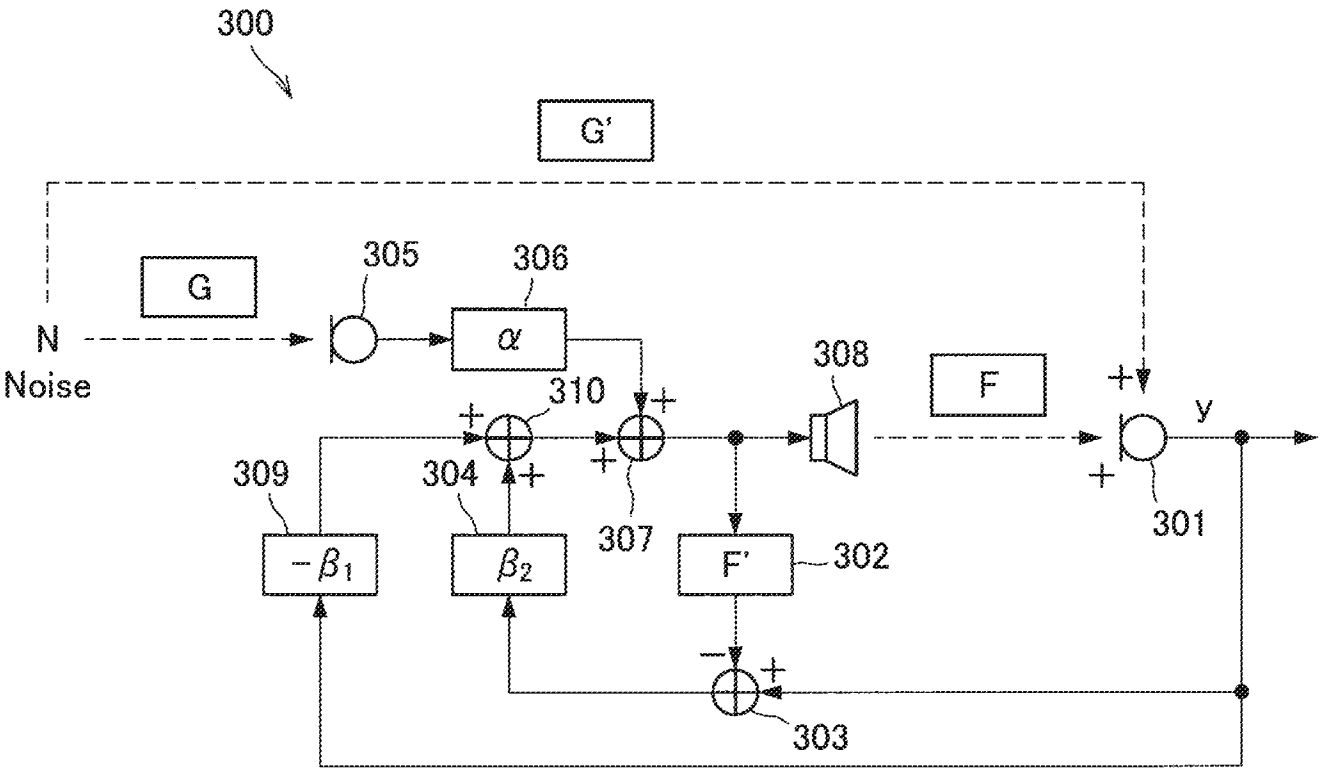
FIG. 6 is a diagram illustrated to describe an exemplary configuration of an ambient noise reduction device 300 using a combination of feedforward-based noise cancellation processing and double feedback-based noise cancellation processing.

FIG. 6 is a diagram illustrated to describe an exemplary configuration of an ambient noise reduction device 300 that employs the combination of the feedforward-based noise cancellation processing and the double feedback-based noise cancellation processing according to the embodiment of the present disclosure.

As illustrated in FIG. 6, the ambient noise reduction device 300 includes microphones 301, 305, filter circuits 304, 306, and 309, a characteristic applying unit 302, a subtractor 303, adders 307 and 310, a speaker 308. In FIG. 6, similarly, the transfer function from the noise source N to the microphone 305 is defined as G, and the transfer function from the noise source N to the microphone 301 is defined as G'.

The ambient noise reduction device 300 illustrated in FIG. 6 has a configuration in which the filter circuit 309 and the adder 310 are added to the ambient noise reduction device 300 illustrated in FIG. 5. The microphone 301, the characteristic applying unit 302, the subtractor 303, the filter circuits 304 and 309, and the adder 310 are equivalent to those of the ambient noise reduction device 200 that performs the double feedback-based noise cancellation processing illustrated in FIG. 4.

The sensitivity function between the ambient noise from the noise source N and the residual signal y in the ambient noise reduction device 300 illustrated in FIG. 6 is calculated as expressed in Formula 6.

[Math. 6]

$$y = \frac{\alpha FG + \beta_2 F' G' + G'}{1+\beta_2(F'-F)+F\beta_1} N \quad \text{(Formula 6)}$$

As is apparent from the sensitivity function in Formula 6, the noise cancellation processing employing the combination of the feedforward system and the double feedback system can be regarded as the addition of the terms of the feedforward system to the double feedback system. Thus, the noise cancellation processing employing the combination of the feedforward system and the double feedback system makes it possible to reduce noise of the residual signal, which is reduced using the IMC method, by further using the feedforward system. In other words, the ambient noise reduction device 300 illustrated in FIG. 6 can achieve more advantageous noise reduction effect as compared to the noise cancellation processing using only the double feedback system.

(Noise Cancellation Processing Corresponding to Noise Environment)

Each of the above-described ambient noise reduction devices may have additional processing of analyzing digital signals of sound collected by the microphone and selecting an optimum one of the ambient noise reduction filters on the basis of the analysis result.

Figure 7:
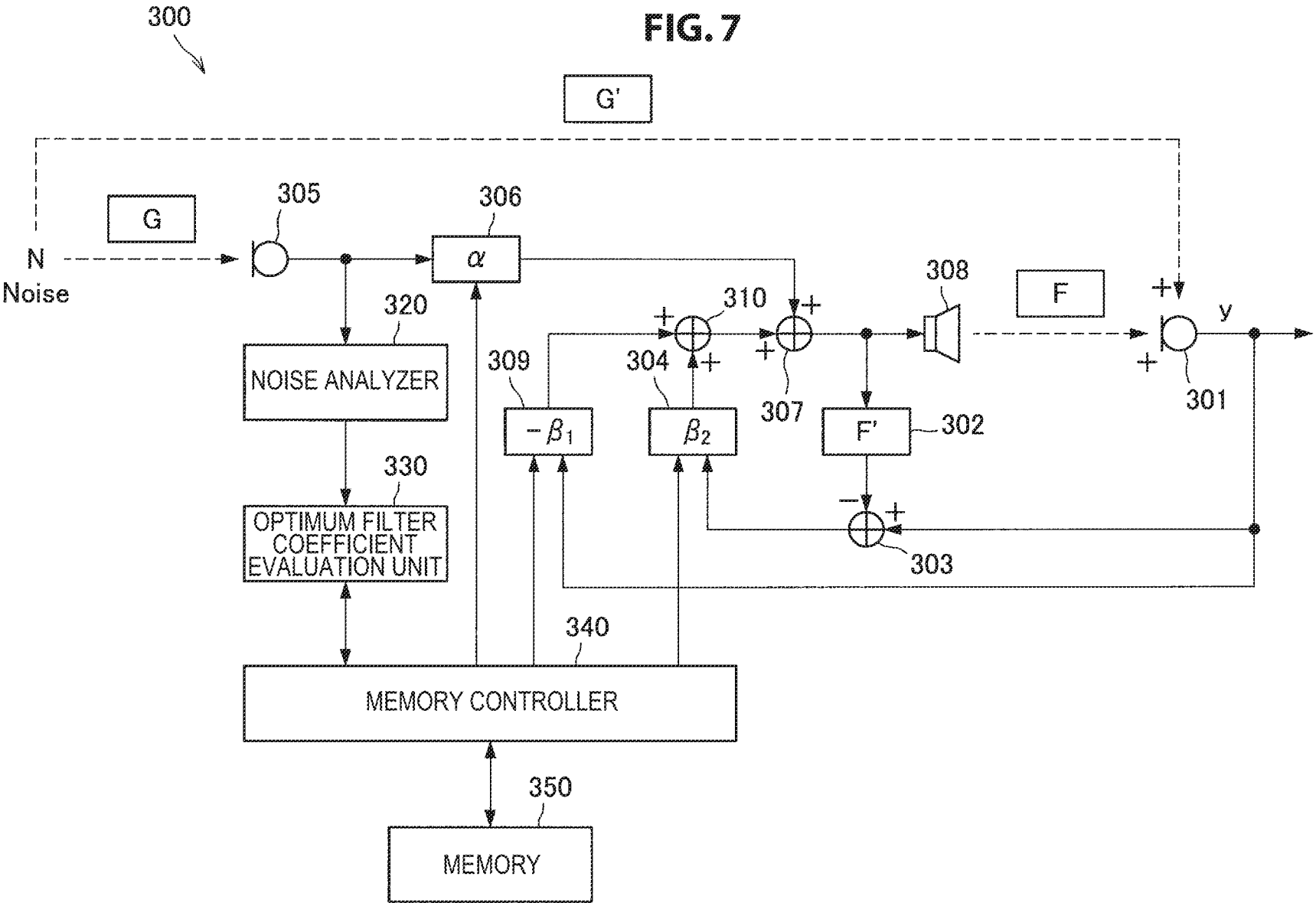
FIG. 7 is a diagram illustrated to describe an exemplary configuration of the ambient noise reduction device 300 using the combination of the feedforward-based noise cancellation processing and the double feedback-based noise cancellation processing.

FIG. 7 is a diagram illustrated to describe an exemplary configuration of an ambient noise reduction device 300 that employs a combination of the feedback-based noise cancellation processing using the double feedback system and the feedforward-based noise cancellation processing, according to the embodiment of the present disclosure.

As illustrated in FIG. 7, the ambient noise reduction device 300 includes microphones 301 and 305, filter circuits 304, 306, and 309, a characteristic applying unit 302, a subtractor 303, adders 307 and 310, a speaker 308, a noise analyzer 320, an optimum filter coefficient evaluation unit 330, a memory controller 340, and a memory 350. In FIG. 7, similarly, the transfer function from the noise source N to the microphone 305 is defined as G, and the transfer function from the noise source N to the microphone 301 is defined as G'.

The noise analyzer 320 analyzes the digital noise signal that is collected and output by the microphone 305. The analysis of the noise signal by the noise analyzer 320 makes it possible to perceive what extent of noise at what kind of frequency band in the noise signal.

Figure 8:
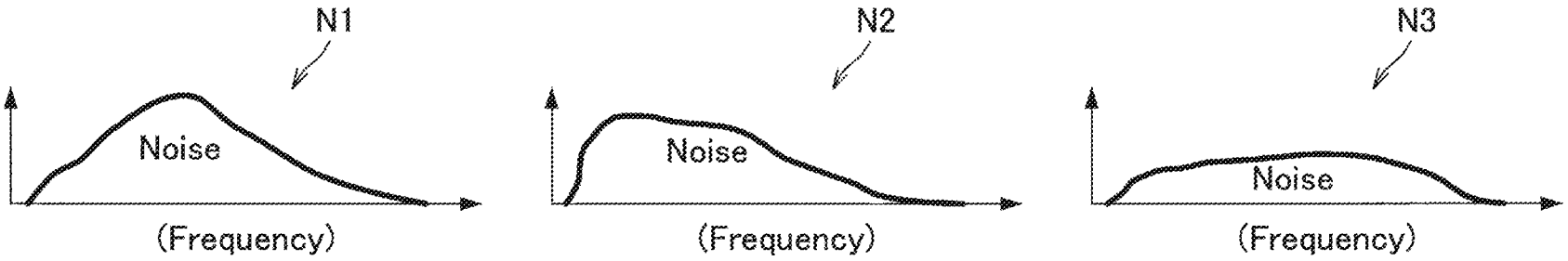
FIG. 8 is a diagram illustrated to describe an example of patterns of noise.

FIG. 8 is a diagram illustrated to describe an example of patterns of noise. In FIG. 8, three noise patterns N1, N2, and N3 are shown, but the noise pattern is not limited to such example, of course. In this way, even if it is simply referred to as noise, various patterns of noise exist. The noise cancellation processing is necessary to be performed in a frequency band where the energy of noise concentrates to achieve the effective reduction of noise. To this end, the noise analyzer 320 analyzes the noise signal.

The optimum filter coefficient evaluation unit 330 determines a filter coefficient that provides the most favorable noise cancellation effect on the basis of the result of analysis of the noise signal by the noise analyzer 320. Then, the memory controller 340 reads filter coefficients for the filter circuits 304, 306, and 309, which are stored in the memory 350, on the basis of the determination result of the filter coefficient by the optimum filter coefficient evaluation unit 330, and sets the read filter coefficient for each of the filter circuits 304, 306, and 309. Moreover, the optimum filter coefficient evaluation unit 330 can determine filter coefficients that provide the most favorable noise cancellation effect for at least one of the filter circuits 304, 306, or 309, not all of them.

In the example illustrated in FIG. 7, although the noise signal collected by the microphone 305 to perform the feedforward-based noise cancellation processing is analyzed, the present disclosure is not limited to this example. In other words, the noise signal collected by the microphone 301 to perform the feedback-based noise cancellation processing can be analyzed.

Figure 9:
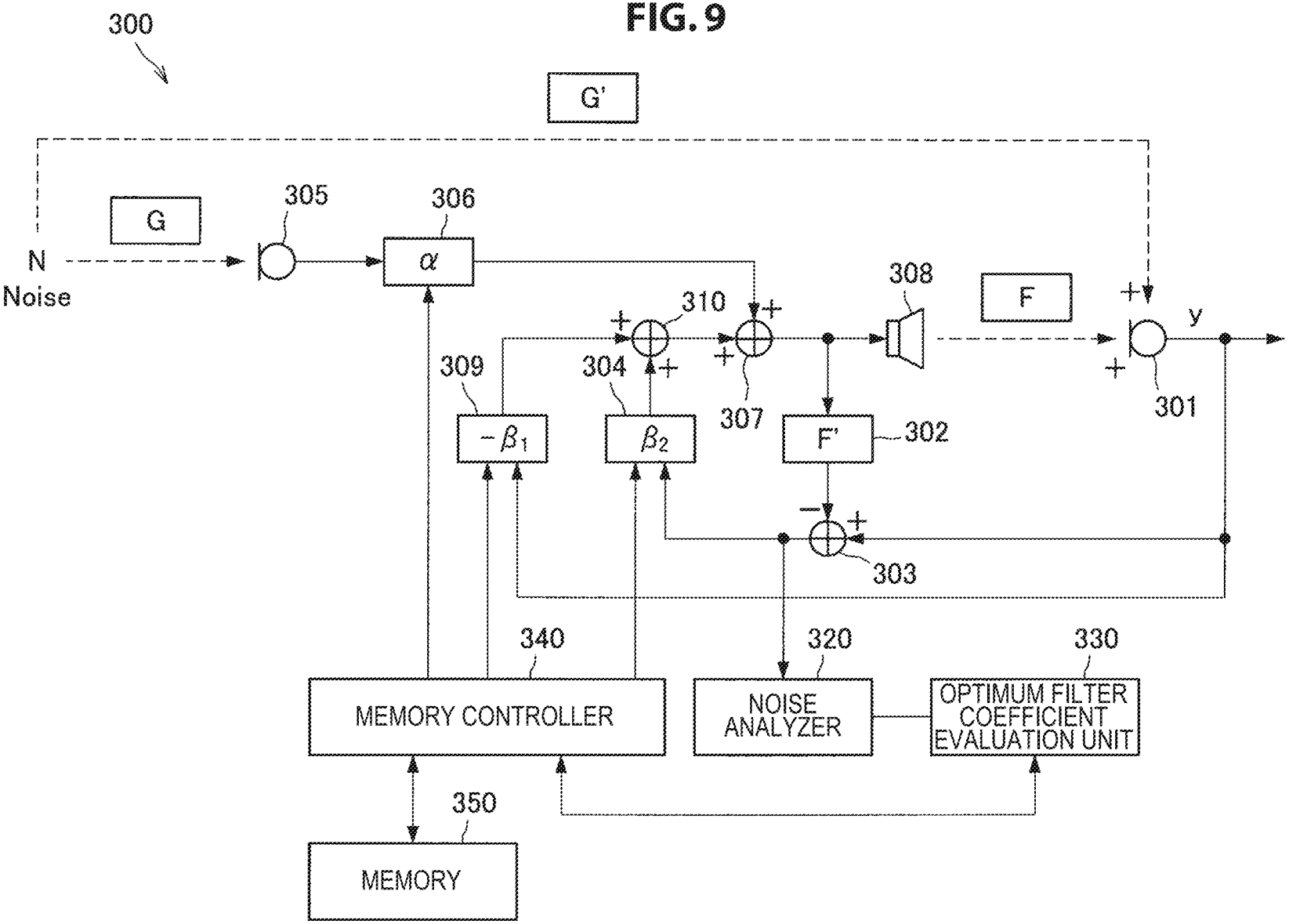
FIG. 9 is a diagram illustrated to describe an exemplary configuration of an ambient noise reduction device 300 using a combination of the feedback-based noise cancellation processing using a double feedback system and the feedback-based noise cancellation processing.

FIG. 9 is a diagram illustrated to describe an exemplary configuration of an ambient noise reduction device 300 that employs the combination of the feedback-based noise cancellation processing using the double feedback system and the feedforward-based noise cancellation processing.

The ambient noise reduction device 300 illustrated in FIG. 9 is similar to the ambient noise reduction device 300 illustrated in FIG. 7 in that it includes the noise analyzer 320, the optimum filter coefficient evaluation unit 330, the memory controller 340, and the memory 350. However, the noise analyzer 320 receives output from the subtractor 303 as an input, which is different from the configuration of the ambient noise reduction device 300 illustrated in FIG. 7.

The reason why the noise analyzer 320 receives the output from the subtractor 303 rather than the output from the microphone 301 as an input is that a component close to the original noise signal can be taken out by using the difference from the path of the IMC system.

When the filter coefficients of the filter circuits 304, 306, and 309 are changed, it is undesirable to make a sudden change. Sudden changes can cause abnormal sound at the time of switching, and this abnormal sound may cause discomfort to the listener.

Figure 10:
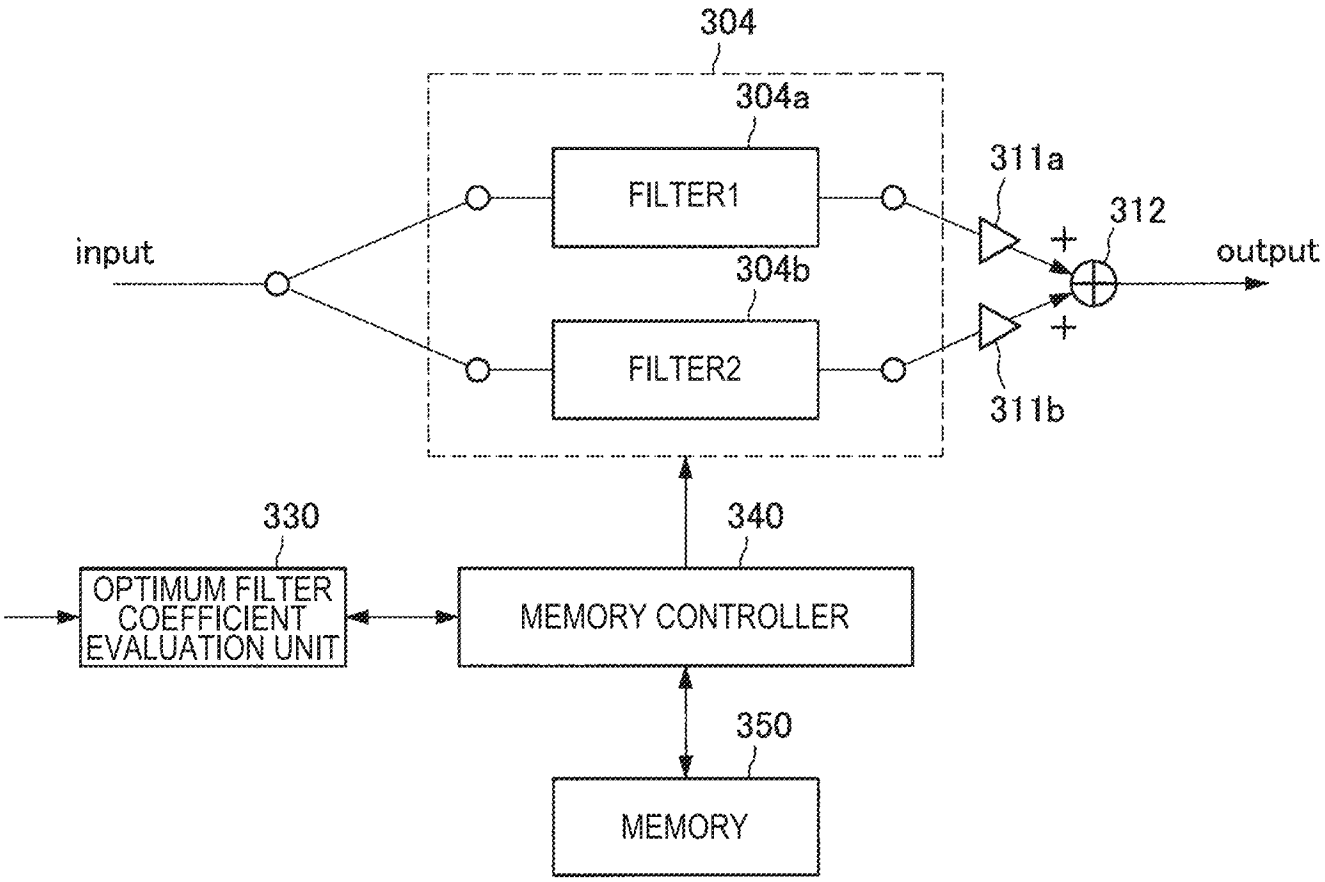
FIG. 10 is a diagram illustrated to describe an exemplary configuration of a filter circuit 304.

Thus, the filter circuits 304, 306, and 309 can have several filter regions in parallel. FIG. 10 is a diagram illustrated to describe an exemplary configuration of the filter circuit 304. The filter circuit 304 illustrated in FIG. 10 has two filter regions 304*a* and 304*b*. In addition, volume faders 311*a* and 311*b* and an adder 312 are provided at a stage following the filter regions 304*a* and 304*b*. The adder 312 adds the outputs of the volume faders 311*a* and 311*b*.

In one example, when the filter region 304*a* is switched into the filter region 304*b*, the switching is performed smoothly by adjusting the volume faders 311*a* and 311*b* without abrupt switching from the filter region 304*a* to the filter region 304*b*. This smooth switching performed by adjusting the volume faders 311*a* and 311*b* makes it possible to prevent the occurrence of abnormal sound in switching from the filter region 304*a* to the filter region 304*b*, thereby preventing the listener from feeling uncomfortable.

Figure 11:
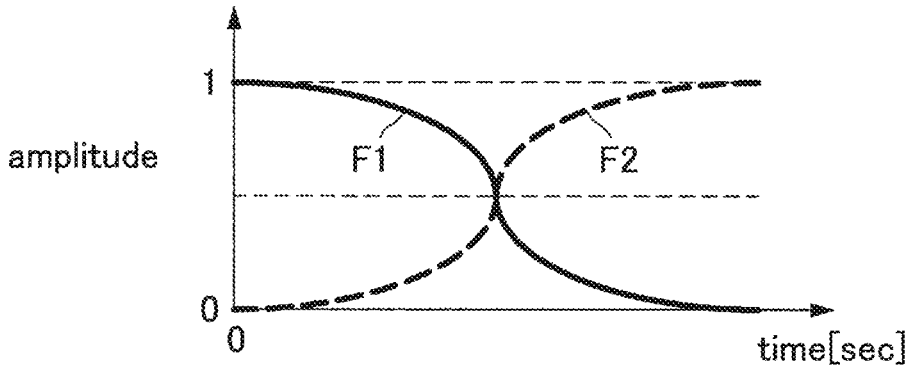
FIG. 11 is a diagram illustrated to describe an example of characteristics of volume faders 311*a* and 311*b*.

The switching between the filter circuits 304 using IMC method in the double feedback-based noise cancellation processing may be performed by switching filters using the volume faders 311*a* and 311*b*. FIG. 11 is a diagram illustrated to describe an example of characteristics of the volume faders 311*a* and 311*b*. FIG. 11 illustrates an output F1 of the volume fader 311*a* and an output F2 of the volume fader 311*b*. In the example illustrated in FIG. 11, the output of the volume fader 311*a* is gradually lowered from 1 times to finally become 0, and conversely the output of the volume fader 311*b* is gradually increased from 0 times to finally become 1. The characteristics of the volume faders 311*a* and 311*b* are certainly not limited to such an example.

(Multiplexing in IMC Method)

Figure 12:
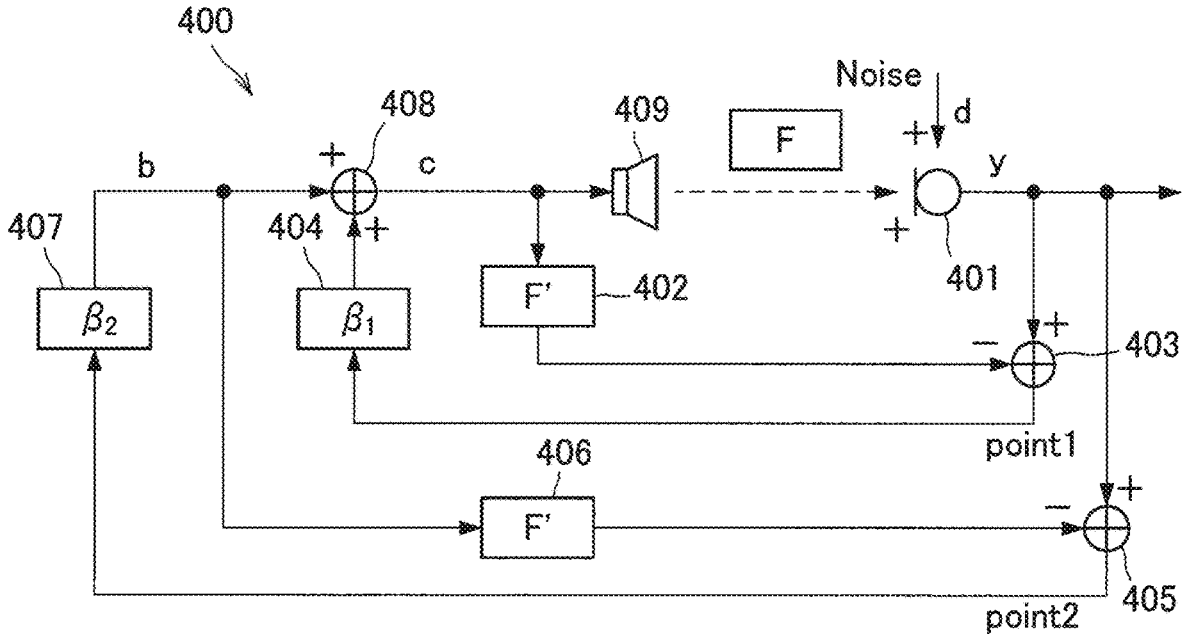
FIG. 12 is a diagram illustrated to describe an exemplary configuration of an ambient noise reduction device 400 that performs feedback-based noise cancellation processing using multiplexed IMC method.

The multiplexing of the feedback-based noise cancellation processing using IMC method is now described. FIG. 12 is a diagram illustrated to describe an exemplary configuration of an ambient noise reduction device 400 that performs the feedback-based noise cancellation processing using the multiplexed IMC method. In FIG. 12, a double-IMC method in which two IMC methods are combined is exemplified, but the multiplexing may be performed for the feedback-based noise cancellation processing using three or more IMC methods.

As illustrated in FIG. 12, the ambient noise reduction device 400 includes a microphone 401, characteristic applying units 402 and 406, subtractors 403 and 405, filter circuits 404 and 407, an adder 408, and a speaker 409.

The ambient noise reduction device 400 illustrated in FIG. 12 is configured by further adding a configuration for performing the feedback-based noise cancellation processing using IMC method to the ambient noise reduction device 100 that performs the feedback-based noise cancellation processing using IMC method illustrated in FIG. 2. In other words, the configuration of the ambient noise reduction device 400 illustrated in FIG. 12 is obtained by adding the characteristic applying unit 406, the subtractor 405, and the filter circuit 407 to the ambient noise reduction device 100.

Considering the IMC method from different perspectives, the IMC method is considered to be processing that can cancel the influence of its own hierarchy and execute signal processing on the restored signal using the internal model. In other words, in the ambient noise reduction device 100 illustrated in FIG. 2, the purpose of the internal model F' applied by the characteristic applying unit 102 is to cancel the influence of the signal that is output from the driver (the speaker 105) and to reproduce the noise signal d.

Referring back to FIG. 12, the multiplexed IMC method has two feedback paths using the internal model F'. As described above, if the internal model control using the IMC method is used, the influence of its own hierarchy can be eliminated. In other words, at point1 in FIG. 12, the influence of the output signal from the driver (the speaker 409) is cancelled and the noise signal d is restored.

On the other hand, focusing on point2, the influence of the hierarchy (referred to as second hierarchy, for convenience) in the filter circuit 407 that applies the gain $\beta_2$ is excluded by using the internal model F'. Thus, only the residual signal cancelled by the hierarchy in the filter circuit 404 that applies the gain $\beta_1$ (referred to as first hierarchy, for convenience) is restored. In other words, the ambient noise reduction processing can be executed again in the second hierarchy on the residual signal that fails to be reduced in the first hierarchy. Thus, the configuration illustrated in FIG. 12 makes it possible to perform the multiplexing of the IMC method.

The sensitivity function between the noise signal d from the noise source N and the residual signal y in the ambient noise reduction device 400 illustrated in FIG. 12 is calculated as expressed in Formula 7 below.

[Math. 7]

$$y = \frac{(1+\beta_1 F')(1+\beta_2 F')}{1+(\beta_1+\beta_2+\beta_1\beta_2 F')(F'-F)}d \qquad \text{(Formula 7)}$$

Referring to Formula 7, two terms in the numerator can be brought close to 0 using $\beta_1$ and $\beta_2$, so the ambient noise reduction device 400 illustrated in FIG. 12 can multiplex the noise reduction effect using the IMC method.

Further, the multiplexing of the feedback-based noise cancellation processing using IMC method makes it possible to change the frequency band of a target for which ambient noise is to be reduced in each hierarchy. Even if the feedback-based noise cancellation processing using CCT method is multiplexed, although the noise reduction effect in the same frequency band can be enhanced, the frequency band of the target for which ambient noise is to be reduced is failed to be changed. On the other hand, the multiplexing of the feedback-based noise cancellation processing using IMC method makes it possible to change the frequency band of the target for which ambient noise is to be reduced by setting the parameters $\beta_1$ and $\beta_2$, so the effect of reducing ambient noise in a wider range is achieved.

Moreover, FIG. 12 illustrates an exemplary configuration of the ambient noise reduction device 400 that performs the feedback-based noise cancellation processing using the multiplexed IMC method. However, it is also possible to add one or both of the configuration that performs the feedback-based noise cancellation processing using CCT method or the configuration that performs the feedforward-based noise cancellation processing to the feedback-based noise cancellation processing using the multiplexed IMC method.

(Combined Use of IMC Method and Monitor)

A way of using by combining the IMC method and a monitor is now described.

It seems that it is highly demanded that the ambient noise is necessary to be reduced in sound unnecessary for the users who use an active headphone having a microphone while checking surrounding environmental sound. The use of the above-described double feedback system makes it possible to achieve monitoring by adding a signal in phase using a monitor signal processing filter to the IMC method while reducing ambient noise in a band undesirable for the user in the CCT method.

Figure 13:
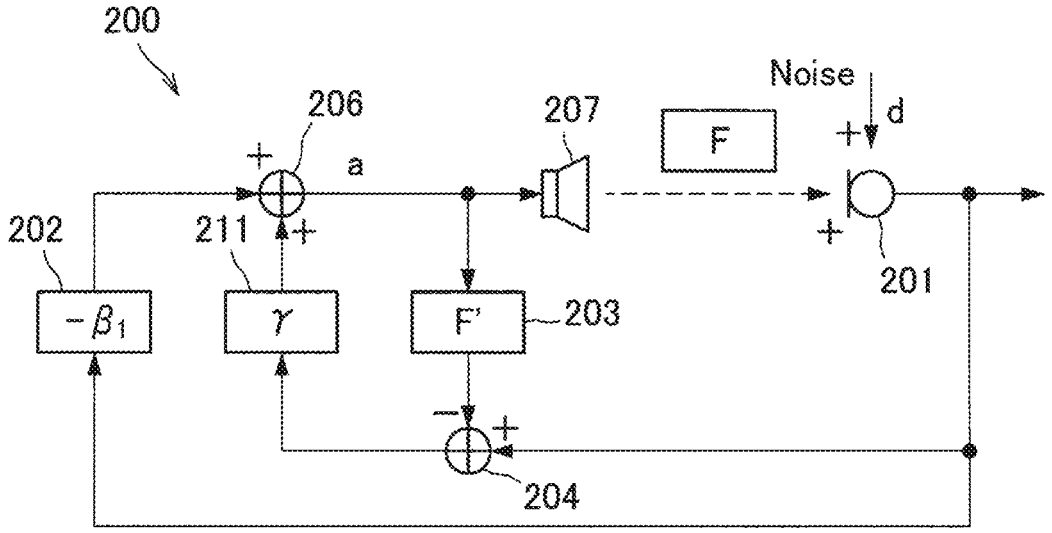
FIG. 13 is a diagram illustrated to describe an exemplary configuration of an ambient noise reduction device 200.

FIG. 13 is a diagram illustrated to describe an exemplary configuration of the ambient noise reduction device 200. FIG. 13 illustrates blocks for signal processing in a case where a filter circuit 211 (filter coefficient $\gamma$) in the loop of the IMC method is used for a monitor application, not for reduction of ambient noise. The filter circuit 211 is provided not for reducing noise but for adding signals in phase. Of course, the sound collected by the microphone 201 is a leakage sound in the headphone, so there is also a possibility that is not suitable for monitor sound.

Thus, in the case of combining the feedforward system and the double feedback system, the signal of the microphone arranged outside the casing is used as a monitor application, and the ambient noise in the unnecessary frequency band can be effectively reduced by using the double feedback system.

Figure 14:
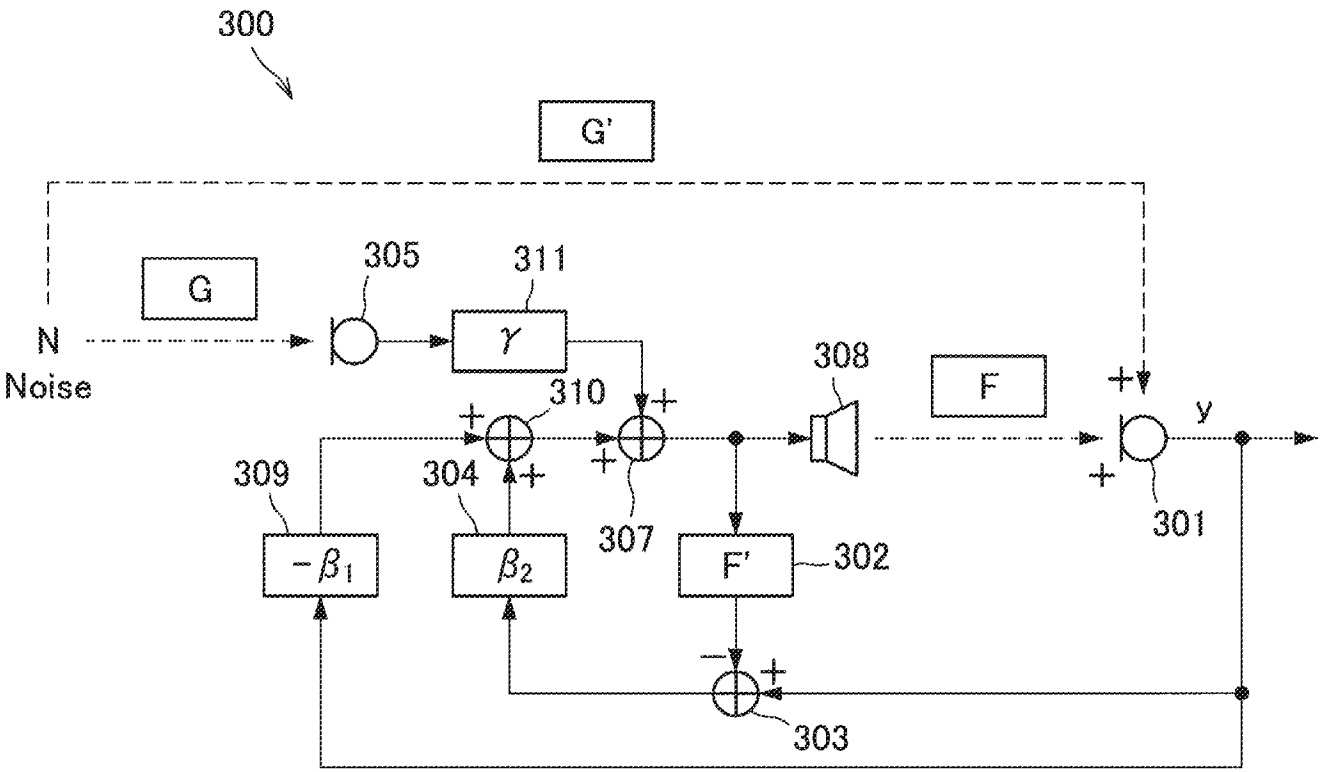
FIG. 14 is a diagram illustrated to describe an exemplary configuration of an ambient noise reduction device 300.

FIG. 14 is a diagram illustrated to describe an exemplary configuration of the ambient noise reduction device 300. FIG. 14 illustrates blocks for signal processing in a case where a filter circuit 311 (filter coefficient $\gamma$) of the feedforward system is used as a monitor application. The filter circuit 311 is provided not for reducing noise but for adding signals in phase. Moreover, similarly to the feedforward system, the IMC method can tune the target frequency, and the ambient noise reduction device 300 illustrated in FIG. 14 can select and reduce a frequency unnecessary for the listener.

(Application to Music Canceller)

The ambient noise reduction device for performing the noise cancellation processing using IMC method has been described above. Then, an example of an application to a music canceller that cancels a music signal supplied from the outside of the sound processing device is described.

Figure 15:
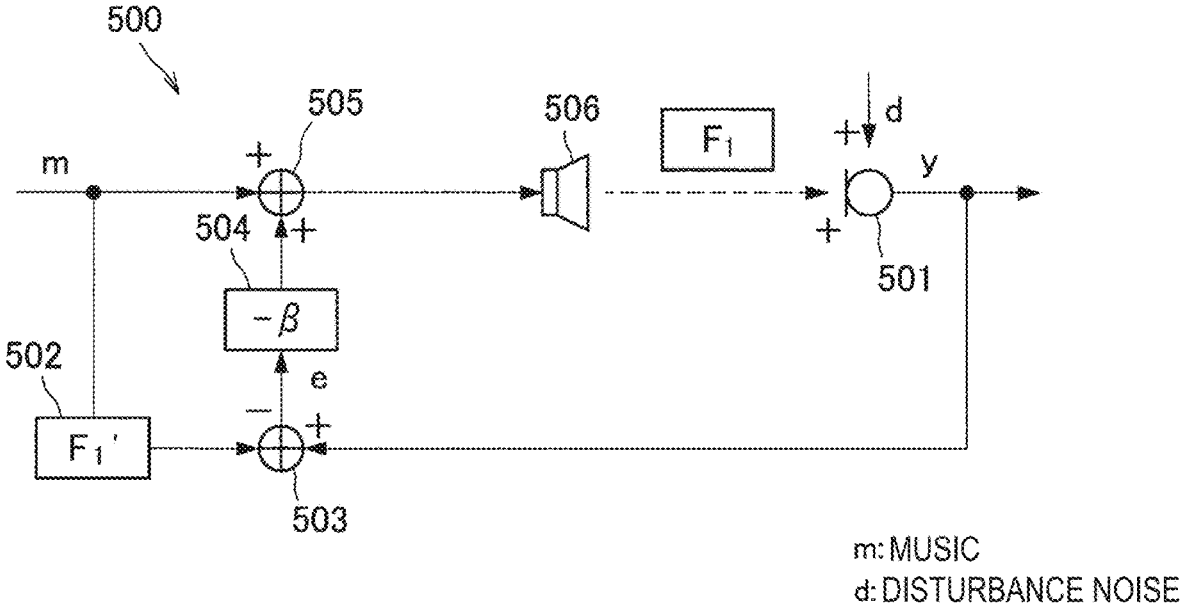
FIG. 15 is a diagram illustrated to describe an exemplary configuration of an ambient noise reduction device 500.

FIG. 15 is a diagram illustrated to describe an exemplary configuration of an ambient noise reduction device 500 according to the embodiment of the present disclosure. As illustrated in FIG. 15, the ambient noise reduction device 500 includes a microphone 501, a characteristic applying unit 502, a subtractor 503, a filter circuit 504, an adder 505, and a speaker 506.

The microphone 501 is provided at a position considered to be close to the user's ear and collects sound at a position close to the user's ear. Thus, the microphone 501 collects external ambient noise reaching the ear. The microphone 501 sets the collected sound as a noise signal d and outputs it to the subtractor 503.

The characteristic applying unit 502 is a circuit that applies a predetermined characteristic $F_1'$ to a music m and outputs it. This characteristic $F_1'$ is a characteristic obtained by simulating the transfer function $F_1$ between the speaker 506 and the microphone 501, and is designed as a plant simulation characteristic of the transfer function $F_1$. The characteristic applying unit 502 outputs a value, which is obtained by applying the predetermined characteristic $F_1'$ to the music m, to the subtractor 503.

The subtractor 503 subtracts the output of the characteristic applying unit 502 from the noise signal that is output from the microphone 501. The subtractor 503 outputs the signal obtained by subtraction to the filter circuit 504.

The filter circuit 504 performs predetermined filtering processing on the signal that is output from the subtractor 503 to generate a noise cancellation signal used to cancel the external ambient noise reaching the user's ear. The filter circuit 504 performs the operation of gain, phase, and amplitude characteristics using the parameter β on the signal that is output from the subtractor 503. The filter circuit 504 can be implemented as, in one example, an FIR filter or an IIR filter.

The adder 505 adds the noise cancellation signal generated by the filter circuit 504 to the music m supplied from the outside of the sound processing device.

The speaker 506 outputs sound by vibrating a diaphragm (not shown) on the basis of the noise cancellation signal that is output from the adder 505. The sound that is output from the speaker 506 is collected by the microphone 201 together with external ambient noise. Thus, the microphone 501 outputs the residual signal y corresponding to the noise that fails to be cancelled by the sound output on the basis of the noise cancellation signal. The microphone 501 and the speaker 506 are provided inside a housing (casing) that is not shown.

The sensitivity function between the noise signal d, the music m, and the residual signal y in the ambient noise reduction device 500 is calculated as expressed in Formula 8.

[Math. 8]

$$\begin{aligned} y &= F_1\{-\beta(-mF_1' + y) + m\} + d \\ y &= mF_1(\beta F_1' + 1) - \beta F_1 y + d \\ (1 + \beta F_1)y &= mF_1(1 + \beta F_1') + d \\ y &= \frac{1 + \beta F_1'}{1 + \beta F_1} F_1 m + \frac{1}{1 + \beta F_1} d \end{aligned} \quad \text{(Formula 8)}$$

The use of the music canceller allows a music component to be prevented from being mixed in a loop using the CCT method in the ambient noise reduction device 500. Thus, the ambient noise reduction device 500 eliminates the necessity for an equalizer for music (or only minor adjustment is necessary).

In Formula 8, β is excluded from the music component if $F_1$ and $F_1'$ are equivalent. Thus, it can be said that, from Formula 8, the music canceller of the ambient noise reduction device 500 is useful.

Moreover, although FIG. 15 illustrates only the configuration for performing the feedback-based noise cancellation processing using CCT method, the configuration for performing the feedback-based noise cancellation processing using the IMC method instead of the CCT method can be used, or the configuration for performing the double feedback-based noise cancellation processing can be used.

Figure 16:
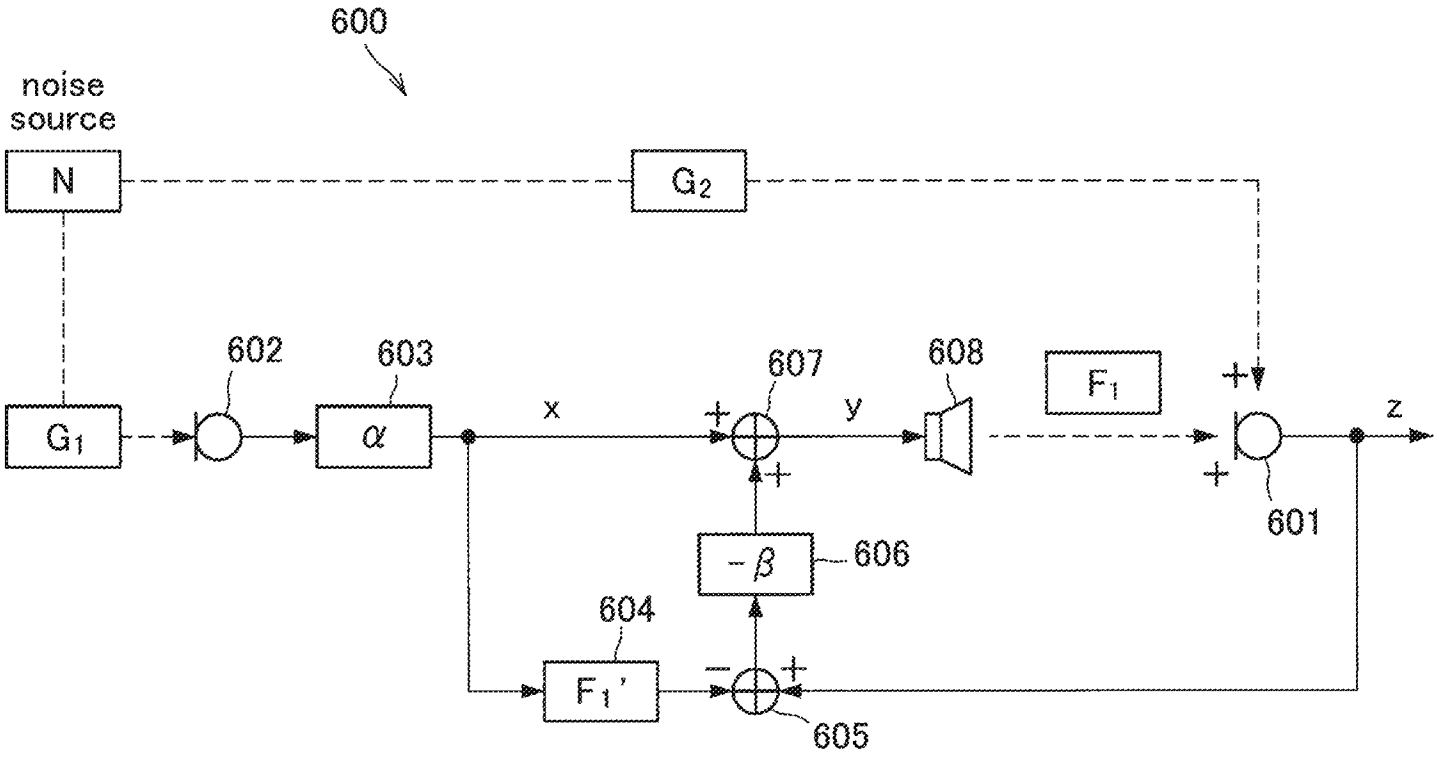
FIG. 16 is a diagram illustrated to describe an exemplary configuration of an ambient noise reduction device 600.

The canceller of the feedforward loop is now described. FIG. 16 is a diagram illustrated to describe an exemplary configuration of an ambient noise reduction device 600 according to the embodiment of the present disclosure. As illustrated in FIG. 16, the ambient noise reduction device 600 includes microphones 601 and 602, filter circuits 603 and 606, a characteristic applying unit 604, a subtractor 605, an adder 607, and a speaker 608.

The sensitivity function between the noise function N and the residual signal z in the ambient noise reduction device 600 is calculated as expressed in Formula 9.

[Math. 9]

$$\begin{aligned} x &= \alpha N G_1 \\ y &= x - \beta(-F_1' x - z) \\ z &= F_1 y + N G_2 \\ y &= \alpha N G_1 + \alpha\beta N F_1' G_1 - \beta z \\ z &= \alpha N F_1 G_1 + \alpha\beta N F_1 F_1' G_1 - \beta F_1 z + N G_2 \\ (1 + \beta F_1)z &= \alpha N F_1 G_1 + \alpha\beta N F_1 F_1' G_1 + N G_2 \\ z &= \frac{\alpha F_1 G_1 + \alpha\beta N F_1 F_1' G_1 + G_2}{1 + \beta F_1} N \\ z &= \frac{(1 + \beta F_1')\alpha F_1 G_1 + G_2}{1 + \beta F_1} N \\ z &= \left(\alpha F_1 G_1 + \frac{G_2}{1 + \beta F_1}\right) N \end{aligned} \quad \text{(Formula 9)}$$

The characteristic $F_1'$ applied in the canceller of the feedforward loop is a characteristic obtained by simulating the transfer function $F_1$ between the speaker 608 and the microphone 601. The use of the canceller of the feedforward loop allows a feedforward component to be prevented from being mixed in the loop of the CCT method in the ambient noise reduction device 600. Further, the use of the characteristic $F_1'$ makes it possible to exclude the component of $F_1$ that is a cause of individual difference and mounting error. Moreover, the last equation in Formula 9 is arranged by replacing $F_1'$ of the immediately preceding equation with $F_1$ on the assumption that $F_1'$ is equal to $F_1$.

Moreover, although FIG. 16 illustrates only the configuration for performing the feedback-based noise cancellation processing using CCT method, the configuration for performing the feedback-based noise cancellation processing using IMC system instead of the CCT method can be used, or the configuration for performing the double feedback-based noise cancellation processing can be used.

Figure 17:
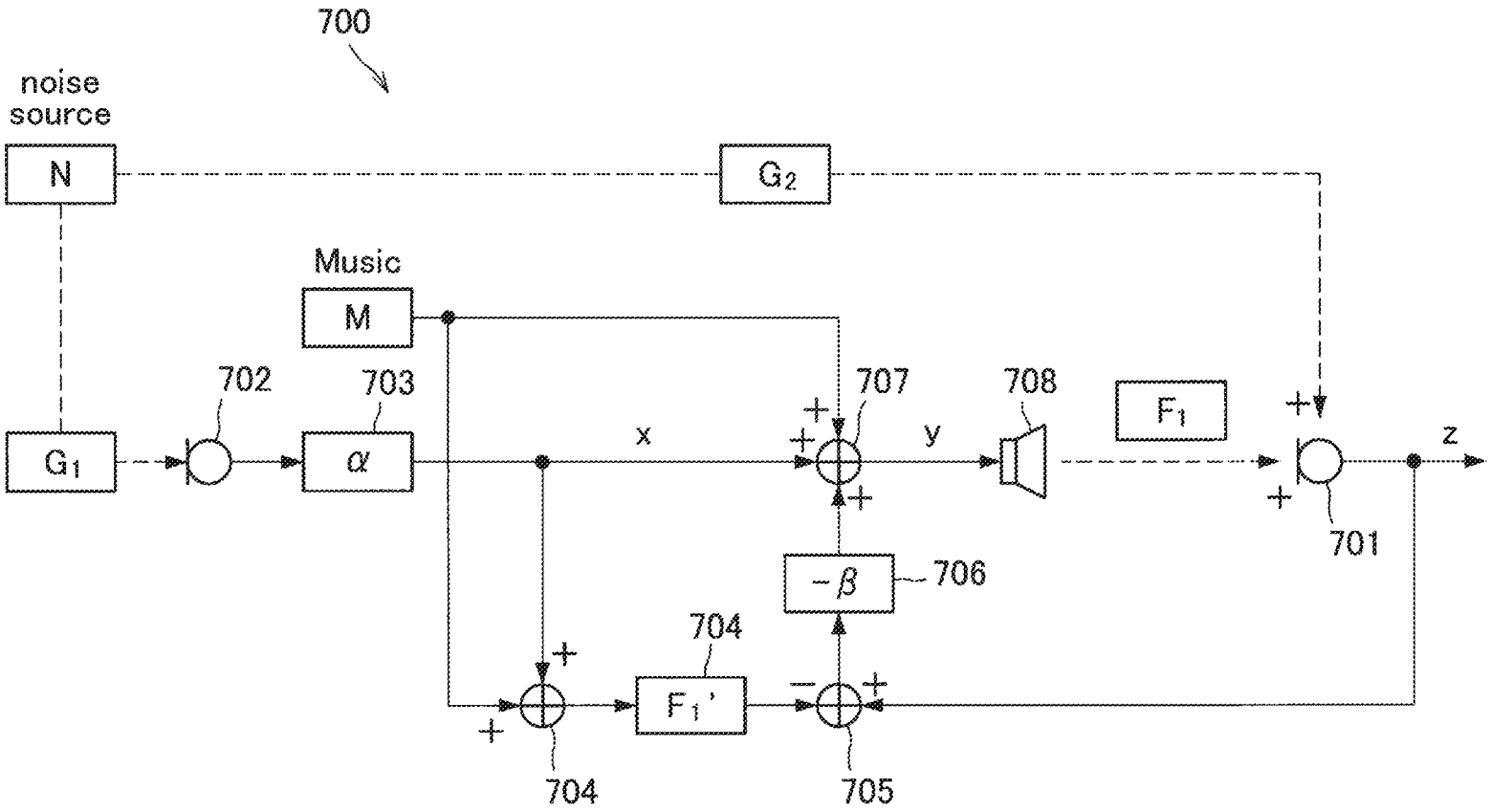
FIG. 17 is a diagram illustrated to describe an exemplary configuration of an ambient noise reduction device 700.

It is also possible to combine the music canceller and a feedforward canceller. FIG. 17 is a diagram illustrated to describe an exemplary configuration of an ambient noise reduction device 700 according to the embodiment of the present disclosure. As illustrated in FIG. 17, the ambient noise reduction device 700 includes microphones 701 and 702, filter circuits 703 and 706, a characteristic applying unit 704, a subtractor 705, adders 707 and 709, and a speaker 708. The configuration illustrated in FIG. 17 is a combination of the ambient noise reduction device 500 including the music canceller illustrated in FIG. 15 and the feedforward canceller illustrated in FIG. 16.

The ambient noise reduction device 700 having the configuration illustrated in FIG. 17 has both functions of the music canceller and the feedforward canceller.

Moreover, although FIG. 17 illustrates only the configuration for performing the feedback-based noise cancellation processing using the CCT method, the configuration for performing the feedback-based noise cancellation processing using the IMC method instead of the CCT method can be used, or the configuration for performing the double feedback-based noise cancellation processing can be used.

(Noise Cancellation Processing Using Detection Result of Simulation Characteristic F')

In the noise cancellation processing using the IMC method described above, the noise cancellation signal is generated using the characteristic F' obtained by simulating the characteristic F. However, the characteristic F contains a variable element. Thus, if the error between the characteristic F and the characteristic F' is large, there is a possibility that the expected noise cancellation effect fails to be achieved.

Thus, the ambient noise reduction device that performs the noise cancellation processing using the IMC method may detect the state of the characteristic F' to lower the gain of the noise cancellation signal or to stop the noise cancellation processing depending on the detection result.

Figure 18:
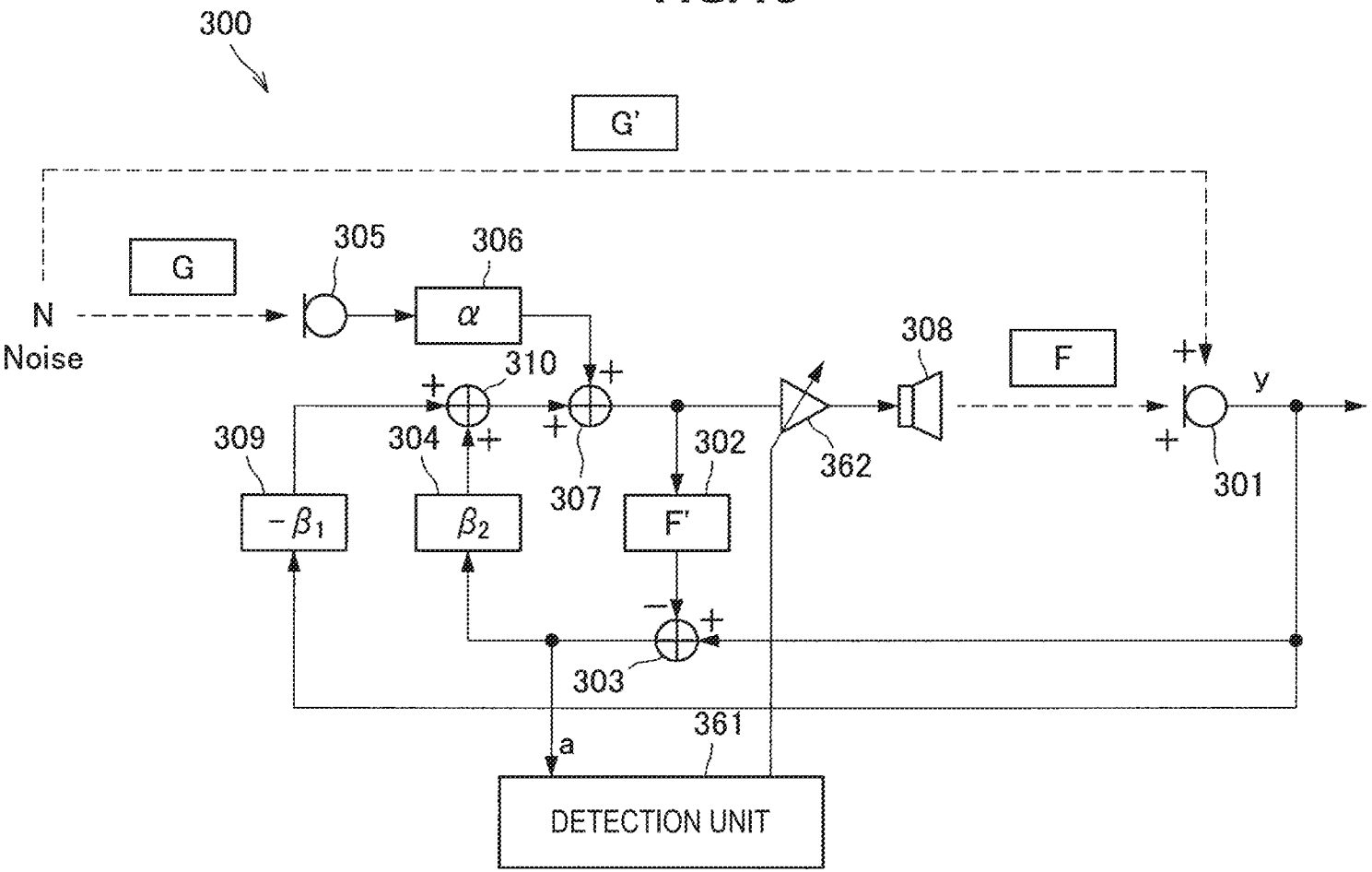
FIG. 18 is a diagram illustrated to describe an exemplary configuration of an ambient noise reduction device 300.

FIG. 18 is a diagram illustrated to describe an exemplary configuration of an ambient noise reduction device 300 according to the embodiment of the present disclosure. FIG. 18 illustrates an exemplary configuration of the ambient noise reduction device 300 in which a detection unit 361 and a fader 362 are added to the ambient noise reduction device 300 illustrated in FIG. 6.

The detection unit 361 detects the state of the signal that is output by the subtractor 303 and is applied with the characteristic F'. Specifically, the detection unit 361 detects the state of the signal applied with the characteristic F', and detects the state of error between the characteristic F and the characteristic F'. The detection unit 361 can detect the state of the signal with respect to the output of the subtractor 303 by using, in one example, a time axis signal, a frequency axis signal, an envelope, a power value, or the like.

The fader 362 changes the gain of the noise cancellation signal that is output by the adder 307 on the basis of the detection result of the detection unit 361. In one example, if the error between the characteristic F and the characteristic F' is within a predetermined range as the result of the detection by the detection unit 361, the fader 362 does not change the gain of the noise cancellation signal that is output by the adder 307. However, if the error between the characteristic F and the characteristic F' exceeds a predetermined range and becomes an abnormal state as the result of the detection by the detection unit 361, the fader 362 reduces the gain of the noise cancellation signal that output by the adder 307 to less than 1 times. The fader 362 may change the reduction amount of the gain depending on the magnitude of the error between the characteristic F and the characteristic F'. In addition, the fader 362 can set the gain to 0 times, that is, not to output the noise cancellation signal output from the adder 307 when the error between the characteristic F and the characteristic F' further increases beyond a predetermined range.

Figure 19:
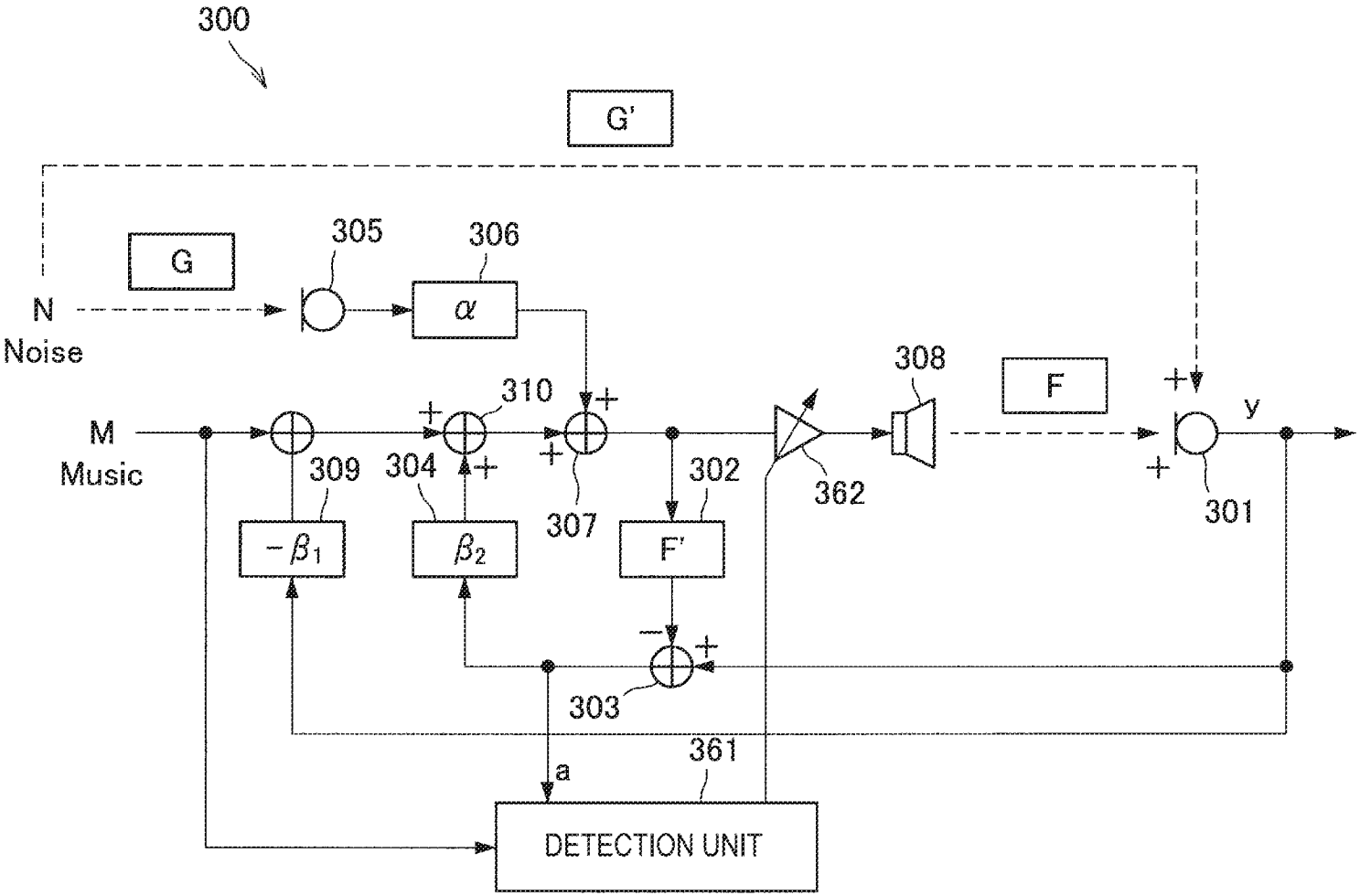
FIG. 19 is a diagram illustrated to describe an exemplary configuration of an ambient noise reduction device 300.

FIG. 19 is a diagram illustrated to describe another exemplary configuration of the ambient noise reduction device 300 according to the embodiment of the present disclosure. The ambient noise reduction device 300 illustrated in FIG. 19 has the configuration similar to that of the ambient noise reduction device 300 illustrated in FIG. 18, but the detection unit 361 receives a music signal M as an input in addition to the signal that is output from the subtractor 303. Then, the detection unit 361 detects the state of the signal to which the characteristic F' is applied. In this event, in addition to the above-described time axis signal, frequency axis signal, envelope, power value, or the like, the detection unit 361 may use the correlation with the music signal M. Then, the fader 362 changes the gain applied to the noise cancellation signal that is output from the adder 307 depending on the detection result of the detection unit 361.

Figure 20:
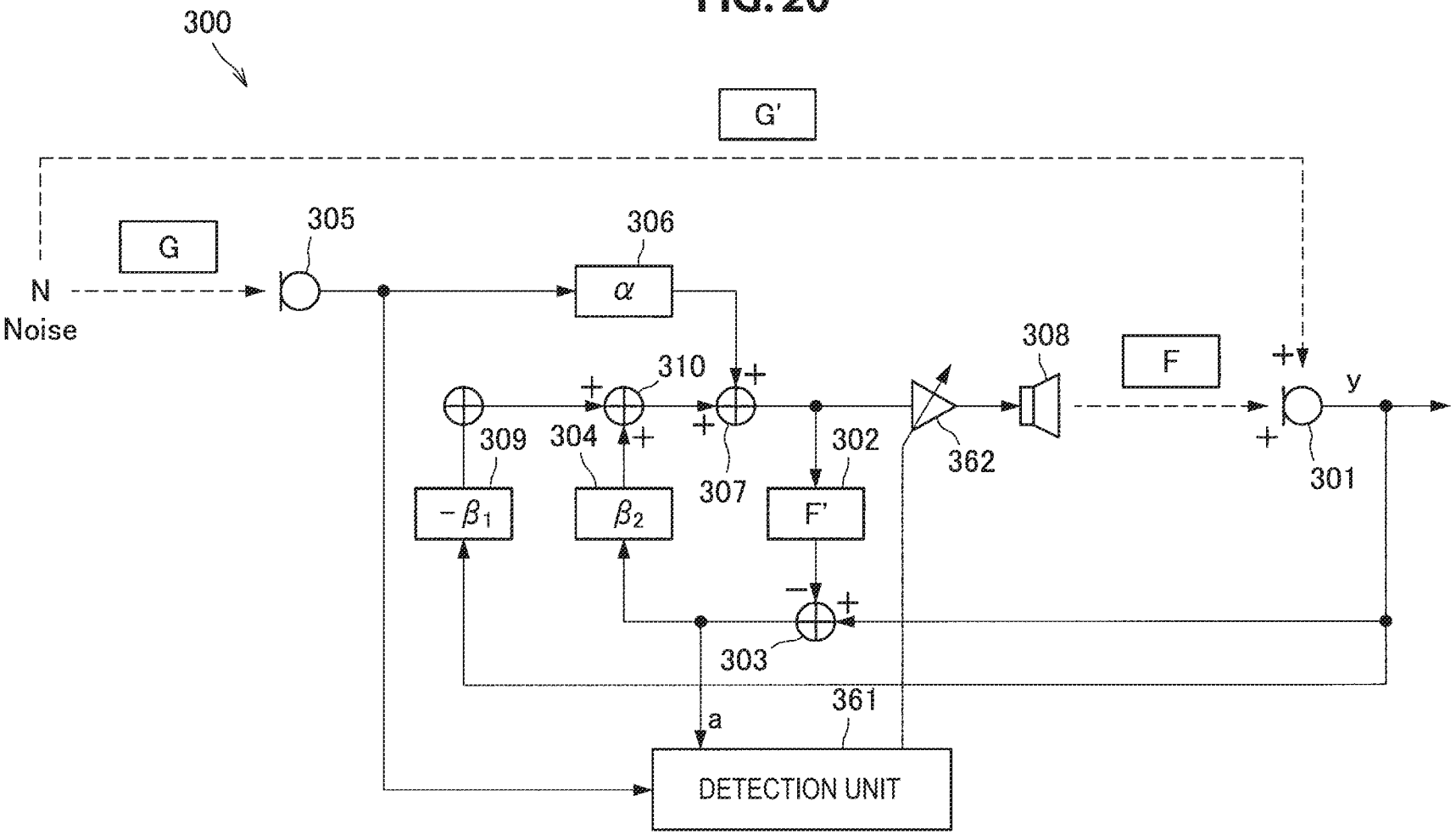
FIG. 20 is a diagram illustrated to describe an exemplary configuration of an ambient noise reduction device 300.

FIG. 20 is a diagram illustrated to describe another exemplary configuration of the ambient noise reduction device 300 according to the embodiment of the present disclosure. The ambient noise reduction device 300 illustrated in FIG. 20 has the configuration similar to that of the ambient noise reduction device 300 illustrated in FIG. 18, but the detection unit 361 receives the output from the microphone 305 as an input in addition to the signal that is output from the subtractor 303. Then, the detection unit 361 detects the state of the signal to which the characteristic F' is applied. In this event, in addition to the above-described time axis signal, frequency axis signal, envelope, power value, or the like, the detection unit 361 may use the correlation with the output from the microphone 305, the difference from the output from the microphone 305, the ratio with the output from the microphone 305, or the like. Then, the fader 362 changes the gain applied to the noise cancellation signal that is output from the adder 307 depending on the detection result obtained by the detection unit 361.

In this way, the state of the signal to which the characteristic F' is applied can be detected and the gain to be applied to the noise cancellation signal can be changed depending on the detection result. This makes it possible for the ambient noise reduction device 300 to slightly weaken the noise cancellation effect or temporarily stop the noise cancellation processing in the case where the error between the characteristic F and the characteristic F' becomes large.

(Application to Automobile Seat)

The ambient noise reduction device that performs the noise cancellation processing using the IMC method as described above is applicable to not only headphones but also other fields. Here, an example of cancelling the noise leaking into the interior of the vehicle by providing any one of the above-described ambient noise reduction devices on an automobile seat is described.

Figure 21:
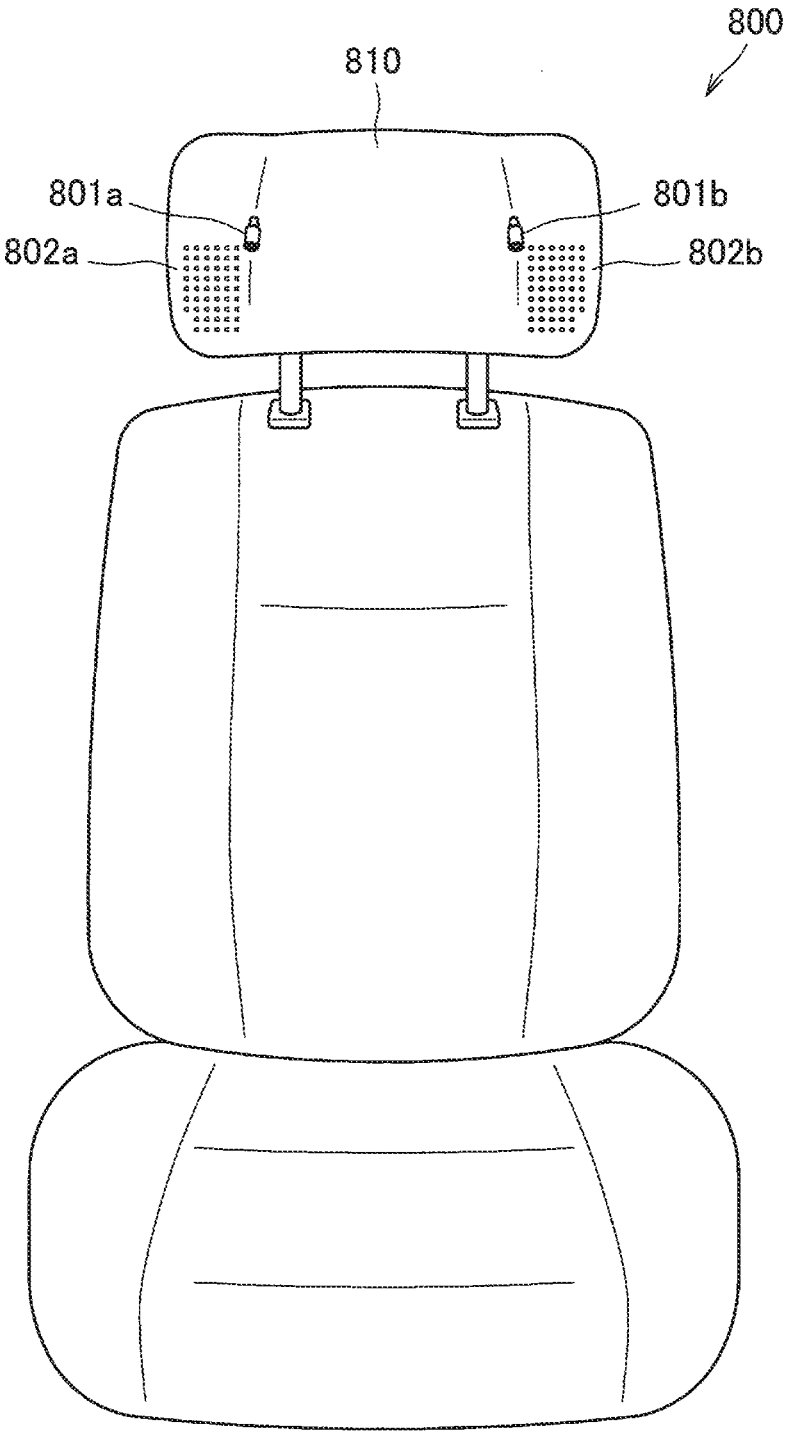
FIG. 21 is a diagram illustrated to describe an appearance example of an automobile seat 800 provided with an ambient noise reduction device.

FIG. 21 is a diagram illustrated to describe an appearance example of an automobile seat 800 provided with any one of the above-described ambient noise reduction devices. In FIG. 21, a headrest 810 of the automobile seat 800 is provided with speakers 802*a* and 802*b* and microphones 801*a* and 801*b*. The automobile seat 800 can be used as any of a driver's seat, a passenger's seat, or a rear seat.

The microphones 801*a* and 801*b* are provided at a position considered to be close to the user's ears and collect sound at a position close to the user's ears, which is similar to that of the ambient noise reduction device described above. Moreover, although two microphones 801*a* and 801*b* are illustrated in FIG. 21, the present disclosure is not limited to this example, and the number of microphones provided in the automobile seat 800 can be one or can be three or more. The speakers 802*a* and 802*b* output the sound based on the noise cancellation signal used to cancel the sound collected by the microphones 801*a* and 801*b*.

The automobile seat 800 having such structure illustrated in FIG. 21 makes it possible to cancel the ambient noise leaking into the interior of the vehicle or being felt by the occupant of the automobile. Especially, the ambient noise reduction device that performs the feedback-based noise cancellation processing using the IMC method or the double feedback-based noise cancellation processing as described above makes it possible for the automobile seat 800 illustrated in FIG. 21 to provide passengers of automobiles with advantageous noise reduction characteristics at low cost.

2. CONCLUDING REMARKS

According to the embodiment of the present disclosure as described above, there is provided an ambient noise reduction device that performs noise cancellation processing using the IMC method. The ambient noise reduction device that performs the noise cancellation processing using the IMC method can be provided with a microphone on the outside of the casing, thereby achieving an effect equivalent to that of the ambient noise reduction device for reducing the noise transmitted to the user's ear.

Further, according to the embodiment of the present disclosure, there is provided an ambient noise reduction device that performs the double feedback-based noise cancellation processing in which the noise cancellation processing using the CCT method employed in related art and the noise cancellation processing using the IMC method are combined. The ambient noise reduction device that performs the double feedback-based noise cancellation processing with one microphone has the effect equivalent to that of the twin-type noise cancellation processing employed in related art. Thus, the ambient noise reduction device that performs the double feedback-based noise cancellation processing eliminates the necessity for additional hardware, so the ambient noise can be effectively reduced at low cost.

Further, according to the embodiment of the present disclosure, there is provided an ambient noise reduction device in which the double feedback-based noise cancellation processing and the feedforward-based noise cancellation processing are combined. Such an ambient noise reduction device employing the combination of the double feedback-based noise cancellation processing and the feedforward-based noise cancellation processing allows further noise reduction effect to be achieved.

In the noise cancellation processing using the IMC method, the fine-tuning is possible for each frequency, which is similar to the feedforward-based noise cancellation processing. Thus, the ambient noise reduction device that performs the noise cancellation processing using the IMC method is capable of handling dynamically a plurality of modes by switching the filter characteristics depending on the feature of noise.

The noise cancellation processing using the IMC method is also the processing of removing the influence of the hierarchy of characteristics. Thus, the ambient noise reduction device that performs the noise cancellation processing using the IMC method is capable of multiplexing the noise cancellation processing using the IMC method by arranging the internal model in a plurality of layers and restoring the residual signal.

Steps in processes executed by the respective devices in this specification are not necessarily executed chronologically in the order described in the sequence chart or the flow chart. In one example, steps in processes executed by the respective devices may be executed in a different order from the order described in the flow chart or may be executed in parallel.

Further, it is also possible to produce a computer program for causing hardware such as a CPU, ROM, or RAM, incorporated in the respective devices, to execute a function equivalent to each configuration of the above-described respective devices. Furthermore, it is possible to provide a recording medium having the computer program recorded thereon. In addition, the respective functional blocks illustrated in the functional block diagram can be configured as hardware or hardware circuits, and thus a series of processing can be implemented using the hardware or hardware circuits.

The preferred embodiment(s) of the present disclosure has/have been described above with reference to the accompanying drawings, whilst the present disclosure is not limited to the above examples. A person skilled in the art may find various alterations and modifications within the scope of the appended claims, and it should be understood that they will naturally come under the technical scope of the present disclosure.

Further, the effects described in this specification are merely illustrative or exemplified effects, and are not limitative. That is, with or in the place of the above effects, the technology according to the present disclosure may achieve other effects that are clear to those skilled in the art from the description of this specification.

Additionally, the present technology may also be configured as below.

(1)

A sound processing device including:

a first sound collector configured to collect a first noise signal from a noise source of noise leaking into a casing mounted to a user's ear;

a first signal processing unit configured to form a first noise reduction signal used to reduce noise at a predetermined cancellation point on the basis of the first noise signal;

a second signal processing unit configured to form a second noise reduction signal used to reduce noise at a predetermined cancellation point with respect to a first pseudo noise signal;

an adder configured to add the first noise reduction signal and the second noise reduction signal; and a sound emitter configured to emit an output of the adder into the casing as sound, in which the first pseudo noise signal is a signal obtained by subtracting an output of the adder applied with a simulation transfer characteristic from an output of the first sound collector, the simulation transfer characteristic being obtained by simulating a transfer characteristic from the sound emitter to the first sound collector.

(2)

The sound processing device according to (1), further including:

a second sound collector being provided outside the casing and configured to collect a second noise signal from the noise source; and a third signal processing unit configured to form a third noise reduction signal used to reduce noise at the cancellation point on the basis of the second noise signal collected by the second sound collector, in which the adder adds the first noise reduction signal, the second noise reduction signal, and the third noise reduction signal.

(3)

The sound processing device according to (2), further including:

an analyzer configured to analyze the second noise signal; and a selection unit configured to select a filter to be used by at least any one of the first to third signal processing units on the basis of an analysis result obtained by the analyzer.

(4)

The sound processing device according to (2), further including:

an analyzer configured to analyze the first pseudo noise signal; and a selection unit configured to select a filter to be used by at least any one of the first to third signal processing units on the basis of an analysis result obtained by the analyzer.

(5)

The sound processing device according to (4), including:

a changing unit configured to change gradually an output in switching between the filters.

(6)

The sound processing device according to any one of (1) to (5), in which the first signal processing unit includes n (where n is an integer of 2 or more) signal processing units, and the first signal processing units each form an n-th noise reduction signal on the basis of an n-th pseudo noise signal obtained by subtracting an output of the first signal processing unit applied with the simulation transfer characteristic from the output of the first sound collector.

(7)

The sound processing device according to any one of (1) to (6), in which the second signal processing unit forms a signal in phase with the first pseudo noise signal instead of forming the second noise reduction signal.

(8)

The sound processing device according to any one of (2) and (3), in which the third signal processing unit forms a signal in phase with the second noise signal instead of forming the third noise reduction signal.

(9)

The sound processing device according to any one of (1) to (9), further including:

a fourth signal processing unit configured to apply the simulation transfer characteristic to an external sound signal, in which the first signal processing unit forms the first noise reduction signal on the basis of a result obtained by subtracting an output of the fourth signal processing unit from the first noise signal.

(10)

The sound processing device according to any one of (2) to (9), further including:

a fourth signal processing unit configured to apply the simulation transfer characteristic to the third noise reduction signal, in which the first signal processing unit forms the first noise reduction signal on the basis of a result obtained by subtracting an output of the fourth signal processing unit from the first noise signal.

(11)

The sound processing device according to (10), in which the fourth signal processing unit applies the simulation transfer characteristic further to an external sound signal.

(12)

The sound processing device according to any one of (1) to (11), including:

a detection unit configured to detect a state of the first pseudo noise signal; and an adjustment unit configured to adjust the output of the adder on the basis of a detection result obtained by the detection unit.

(13)

The sound processing device according to (12), in which the detection unit detects the state of the first pseudo noise signal on the basis of an external sound signal.

(14)

The sound processing device according to any one of (2) to (11), including:

a detection unit configured to detect a state of the first pseudo noise signal on the basis of the third noise reduction signal; and an adjustment unit configured to adjust the output of the adder on the basis of a detection result obtained by the detection unit.

(15)

The sound processing device according to (14), in which the detection unit detects the state of the first pseudo noise signal on the basis of an external sound signal.

(16)

A sound processing method including:

collecting, by a first sound collector, a first noise signal from a noise source of noise leaking into a casing mounted to a user's ear;

forming a first noise reduction signal used to reduce noise at a predetermined cancellation point on the basis of the first noise signal;

forming a second noise reduction signal used to reduce noise at a predetermined cancellation point with respect to a first pseudo noise signal;

adding the first noise reduction signal and the second noise reduction signal; emitting, by a sound emitter, the added signal into the casing as sound; and applying a simulation transfer characteristic to the added signal, the simulation transfer characteristic being obtained by simulating a transfer characteristic from the sound emitter to the first sound collector, in which the first pseudo noise signal is a signal obtained by subtracting a signal applied with the simulation transfer characteristic from an output of the first sound collector.

(17)

A computer program causing a computer to execute:

forming a first noise reduction signal used to reduce noise at a predetermined cancellation point on the basis of a first noise signal from a noise source of noise leaking into a casing mounted to a user's ear, the first noise signal being collected by a first sound collector;

forming a second noise reduction signal used to reduce noise at a predetermined cancellation point with respect to a first pseudo noise signal;

adding the first noise reduction signal and the second noise reduction signal;

emitting, by a sound emitter, the added signal into the casing as sound; and applying a simulation transfer characteristic to the added signal, the simulation transfer characteristic being obtained by simulating a transfer characteristic from the sound emitter to the first sound collector, in which the first pseudo noise signal is a signal obtained by subtracting a signal applied with the simulation transfer characteristic from an output of the first sound collector.

REFERENCE SIGNS LIST

100 ambient noise reduction device
101 microphone
102 characteristic applying unit
103 subtractor
104 filter circuit
105 speaker
200 ambient noise reduction device
201 microphone
202 filter circuit
203 characteristic applying unit
204 subtractor
205 filter circuit
206 adder
207 speaker
800 automobile seat
801*a* microphone
801*b* microphone
802*a* speaker
802*b* speaker
810 headrest

The invention claimed is:

1. A sound processing device comprising:

a first sound collector configured to collect a first noise signal from a noise source of noise leaking into a casing mounted to a user's ear;

a first filter circuit configured to generate a first noise reduction signal used to reduce noise at a predetermined cancellation point based on the first noise signal;

a second filter circuit configured to generate a second noise reduction signal used to reduce noise at the predetermined cancellation point based on a first pseudo noise signal;

a second sound collector being provided outside the casing and configured to collect a second noise signal from the noise source;

a third filter circuit configured to generate a third noise reduction signal used to reduce noise at the predetermined cancellation point based on the second noise signal collected by the second sound collector;

an adder configured to add the first noise reduction signal, the second noise reduction signal and the third noise reduction signal; and a sound emitter configured to emit an output of the adder into the casing as sound, wherein the first pseudo noise signal is a signal obtained by subtracting a first simulation transfer output, determined by applying a simulation transfer characteristic to an output of the adder, from an output of the first sound collector, the simulation transfer characteristic being obtained by simulating a transfer characteristic from the sound emitter to the first sound collector.

2. The sound processing device according to claim 1, further comprising:

an analyzer configured to analyze the second noise signal; and a selection unit configured to select a filter to be used by at least any one of the first to third filter circuits on a basis of an analysis result obtained by the analyzer.

3. The sound processing device according to claim 1, further comprising:

an analyzer configured to analyze the first pseudo noise signal; and a selection unit configured to select a filter to be used by at least any one of the first to third filter circuits on a basis of an analysis result obtained by the analyzer.

4. The sound processing device according to claim 3, comprising:

a changing unit configured to change gradually an output in switching between a first filter and a second filter.

5. The sound processing device according to claim 1, wherein the first filter circuit includes n (where n is an integer of 2 or more) filters, and the n filters each generate an n-th noise reduction signal on a basis of an n-th pseudo noise signal obtained by subtracting a second simulation transfer output, determined by applying a simulation transfer characteristic to an output of the first filter circuit, from the output of the first sound collector.

6. The sound processing device according to claim 1, further comprising:

a fourth filter circuit configured to apply the simulation transfer characteristic to the third noise reduction signal, wherein the first filter circuit generates the first noise reduction signal based on a result obtained by subtracting an output of the fourth filter circuit from the first noise signal.

7. The sound processing device according to claim 6, wherein the fourth filter circuit applies the simulation transfer characteristic to an external sound signal.

8. The sound processing device according to claim 1, comprising:

a detection unit configured to detect a state of the first pseudo noise signal; and an adjustment unit configured to adjust the output of the adder on a basis of a detection result obtained by the detection unit.

9. The sound processing device according to claim 8, wherein the detection unit detects the state of the first pseudo noise signal on a basis of an external sound signal.

10. A sound processing method comprising:

collecting, by a first sound collector, a first noise signal from a noise source of noise leaking into a casing mounted to a user's ear;

generating a first noise reduction signal used to reduce noise at a predetermined cancellation point based on the first noise signal;

generating a second noise reduction signal used to reduce noise at the predetermined cancellation point based on a first pseudo noise signal;

collecting, by a second sound collector provided outside the casing, a second noise signal from the noise source;

generating a third noise reduction signal used to reduce noise at the predetermined cancellation point based on the second noise signal collected by the second sound collector;

adding the first noise reduction signal, the second noise reduction signal and the third noise reduction signal to generate an added signal;

emitting, by a sound emitter, the added signal into the casing as sound; and applying a simulation transfer characteristic to the added signal to generate a simulation transfer output, the simulation transfer characteristic being obtained by simulating a transfer characteristic from the sound emitter to the first sound collector, wherein the first pseudo noise signal is a signal obtained by subtracting the simulation transfer output from an output of the first sound collector.

11. A non-transitory computer readable medium containing computer readable instructions that, when executed by a computer, perform a sound processing method comprising:

generating a first noise reduction signal used to reduce noise at a predetermined cancellation point based on a first noise signal from a noise source of noise leaking into a casing mounted to a user's ear, the first noise signal being collected by a first sound collector;

generating a second noise reduction signal used to reduce noise at the predetermined cancellation point based on a first pseudo noise signal;

generating a third noise reduction signal used to reduce noise at the predetermined cancellation point based on a second noise signal collected by a second sound collector provided outside the casing;

adding the first noise reduction signal, the second noise reduction signal and the third noise reduction signal to generate an added signal;

emitting, by a sound emitter, the added signal into the casing as sound; and applying a simulation transfer characteristic to the added signal to generate a simulation transfer output, the simulation transfer characteristic being obtained by simulating a transfer characteristic from the sound emitter to the first sound collector, wherein the first pseudo noise signal is a signal obtained by subtracting the simulation transfer output from an output of the first sound collector.

* * * * *